US012515103B2

(12) United States Patent
Kim et al.

(10) Patent No.: US 12,515,103 B2
(45) Date of Patent: Jan. 6, 2026

(54) METHOD AND SYSTEM FOR PROVIDING EXERCISE PROGRAM TO USER

(71) Applicant: Samsung Electronics Co., Ltd., Suwon-si (KR)

(72) Inventors: Hongyoon Kim, Suwon-si (KR); Jaehun Hyeon, Suwon-si (KR); Dongwoo Kim, Suwon-si (KR); Kiljong Kim, Suwon-si (KR); Jongwon Kim, Suwon-si (KR); Seungyeon Eom, Suwon-si (KR); Kiwan Lee, Suwon-si (KR); Hyunkook Cho, Suwon-si (KR); Sukwon Choi, Suwon-si (KR); Kwanghyung Lee, Seoul (KR); Myeonghee Jeon, Seoul (KR); Yuchang Jeong, Seoul (KR); Jiwon Ha, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 153 days.

(21) Appl. No.: 18/482,146

(22) Filed: Oct. 6, 2023

(65) Prior Publication Data

US 2024/0033578 A1 Feb. 1, 2024

Related U.S. Application Data

(63) Continuation of application No. PCT/KR2023/003315, filed on Mar. 10, 2023.

(30) Foreign Application Priority Data

May 9, 2022 (KR) ..... 10-2022-0056771
Aug. 23, 2022 (KR) ..... 10-2022-0105747

(51) Int. Cl.
*A63B 24/00* (2006.01)

(52) U.S. Cl.
CPC ..... *A63B 24/0075* (2013.01)

(58) Field of Classification Search
CPC ..... A63B 24/0075; A63B 21/4009; A63B 21/4011; A63B 2071/0666;
(Continued)

(56) References Cited

U.S. PATENT DOCUMENTS 11,023,818 B2 * 6/2021 Awiszus ..... G06N 20/00
11,772,259 B1 * 10/2023 Kiehl ..... A61H 3/00 700/245

(Continued)

FOREIGN PATENT DOCUMENTS

JP 2021192154 A 12/2021
KR 20160054325 A 5/2016

(Continued)

*Primary Examiner* — Sundhara M Ganesan
(74) *Attorney, Agent, or Firm* — NIXON & VANDERHYE P.C.

(57) ABSTRACT

An exercise program determining method and/or system may include obtaining basic exercise information of a user, determining at least one candidate exercise mode from among a plurality of exercise modes based on the basic exercise information, generating a plurality of exercise programs to include at least some of the at least one candidate exercise mode based on a target exercise result for the user, determining a target exercise amount for the user based on the basic exercise information, and determining a target exercise program from among the plurality of exercise programs based on the target exercise amount.

19 Claims, 18 Drawing Sheets

(58) Field of Classification Search
CPC ..... A63B 21/00181; A63B 21/0058; A63B 21/4025; A63B 21/4047; A63B 23/03541; A63B 23/0482; A63B 24/0062; A63B 2024/0068; A63B 2024/0093; A63B 2220/30; A63B 2220/40; A63B 2220/51; A63B 2220/803; A63B 2220/806; A63B 2220/836; A63B 2225/20; A63B 24/0087; A63B 2225/50; A63B 2230/50; A63B 71/06; A63B 24/00; G16H 50/20; G16H 20/30; G16H 40/63; G16H 40/67
See application file for complete search history.

(56) References Cited

U.S. PATENT DOCUMENTS

| | | | | |
|---|---|---|---|---|
| 2017/0202724 | A1 | 7/2017 | De Rossi et al. | |
| 2017/0245570 | A1* | 8/2017 | Yuen | A41D 1/14 |
| 2019/0269971 | A1 | 9/2019 | Capell et al. | |
| 2022/0004167 | A1* | 1/2022 | Zealand | G16H 20/30 |

FOREIGN PATENT DOCUMENTS

| | | | |
|---|---|---|---|
| KR | 20170018709 | A | 2/2017 |
| KR | 20170039066 | A | 4/2017 |
| KR | 20180063948 | A | 6/2018 |
| KR | 20190047644 | A | 5/2019 |
| KR | 20190142906 | A | 12/2019 |
| KR | 20210118498 | A | 10/2021 |
| KR | 20210123012 | A | 10/2021 |
| KR | 20220017120 | A | 2/2022 |
| KR | 20220037419 | A | 3/2022 |

* cited by examiner

METHOD AND SYSTEM FOR PROVIDING EXERCISE PROGRAM TO USER

CROSS-REFERENCE TO RELATED APPLICATIONS

This application is a continuation of International Application No. PCT/KR2023/003315 designating the United States, filed on Mar. 10, 2023, in the Korean Intellectual Property Receiving Office and claiming priority to Korean Patent Application No. 10-2022-0056771 filed on May 9, 2022, and Korean Patent Application No. 10-2022-0105747 filed on Aug. 23, 2022, in the Korean Intellectual Property Office, the disclosures of which are all hereby incorporated by reference herein in their entireties.

BACKGROUND

1. Field

Certain embodiments relate to a technology for providing an exercise program to a user.

2. Description of Related Art

Aging demographics have contributed to a growing number of people who experience inconvenience and/or pain from reduced muscular strength or aging-induced joint problems. Thus, there is a growing interest in walking assist devices that enable elderly users or patients with reduced muscular strength or joint problems to walk with less effort.

SUMMARY

According to an example embodiment, a server may include a communication module, including communication circuitry, configured to exchange data with an external device, and at least one processor configured to control the server. The at least one processor may be configured to obtain basic exercise information of a user of an electronic device; determine at least one candidate exercise mode from among a plurality of exercise modes stored in the server based on the basic exercise information; generate a plurality of exercise programs to include at least some of the at least one candidate exercise mode based on a target exercise result for the user; determine a target exercise amount for the user based on the basic exercise information; determine a target exercise program from among the plurality of exercise programs based on the target exercise amount; and transmit information related to the target exercise program to the electronic device.

According to an example embodiment, an exercise program determining method performed by a server may be provided, and the method may include: obtaining basic exercise information of a user of an electronic device; determining one or more candidate exercise modes from among a plurality of exercise modes stored in the server based on the basic exercise information; generating a plurality of exercise programs to include at least some of the one or more candidate exercise modes based on a target exercise result for the user; determining a target exercise amount for the user based on the basic exercise information; determining a target exercise program from among the plurality of exercise programs based on the target exercise amount; and transmitting information related to the target exercise program to the electronic device.

According to an example embodiment, electronic device may include a communication module, including communication circuitry, configured to exchange data with an external device, and at least one processor configured to control the electronic device. The at least one processor may be configured to obtain basic exercise information of a user of the electronic device; determine one or more candidate exercise modes from among a plurality of exercise modes stored in the electronic device based on the basic exercise information; generate a plurality of exercise programs to include at least some of the one or more candidate exercise modes based on a target exercise result for the user; determine a target exercise amount for the user based on the basic exercise information; determine a target exercise program from among the plurality of exercise programs based on the target exercise amount; and control a wearable device worn on the user based on the target exercise program.

Other features and aspects will be apparent from the following detailed description, the drawings, and the claims.

BRIEF DESCRIPTION OF THE DRAWINGS

The above and other aspects, features, and advantages of certain embodiments of the present disclosure will be more apparent from the following detailed description, taken in conjunction with the accompanying drawings, in which.

DETAILED DESCRIPTION

Hereinafter, various example embodiments will be described with reference to the accompanying drawings. However, the example embodiments are not intended to limit the present disclosure, but various changes, modifications, equivalents, and/or alternatives of the embodiments will be apparent after an understanding of the disclosure.

Figure 1:
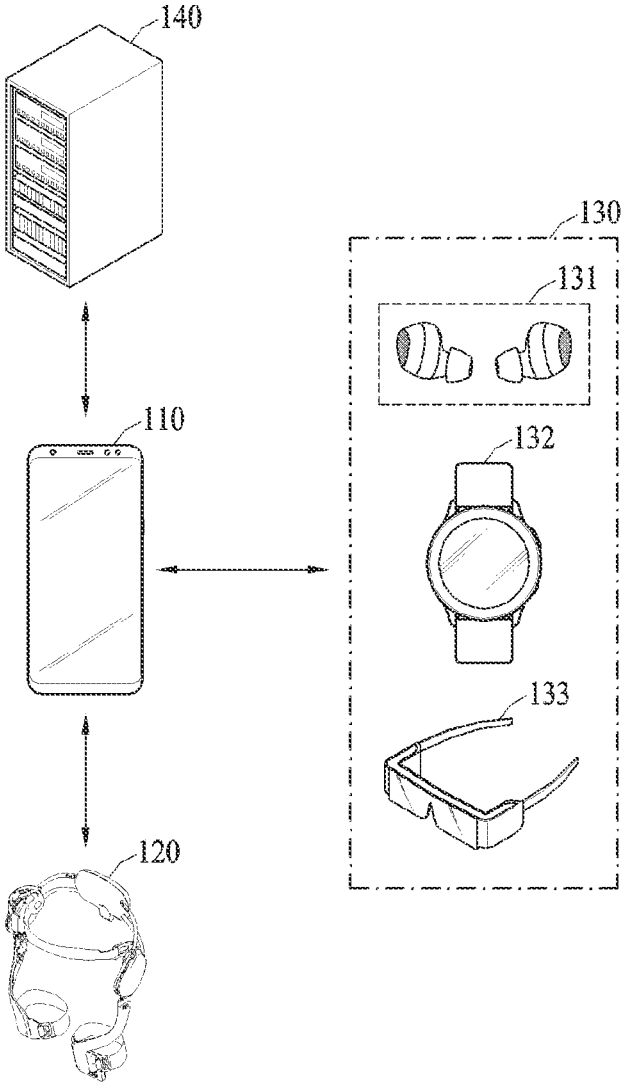
FIG. 1 is a diagram illustrating an example configuration of a system for providing an exercise program to a user according to an example embodiment.

FIG. 1 is a diagram illustrating an example configuration of a system for providing an exercise program to a user according to an embodiment.

According to an embodiment, a system for providing an exercise program to a user may include an electronic device 110, a wearable device 120, an additional device 130, and a server 140.

According to an embodiment, the electronic device 110 may be a user terminal connectable to the wearable device 120 using short-range wireless communication. For example, the electronic device 110 may transmit, to the wearable device 120, a control signal for controlling the wearable device 120. The electronic device 110 will be described in greater detail below with reference to FIG. 2, and the transmission of a control signal will be described in greater detail below with reference to FIG. 4.

According to an embodiment, the wearable device 120 may provide a user wearing the wearable device 120 with an assistance force to assist the user in walking or with a resistance force to hinder the user from walking. The resistance force may also be provided to the user for the user to do an exercise. The assistance force or the resistance force output by the wearable device 120 may be controlled, as values of various control parameters used for the wearable device 120 are controlled. A structure of the wearable device 120 and a method of operating the wearable device 120 will be described in detail below with reference to FIGS. 3A, 3B, 3C, 3D, 4, 5, and 6.

According to an embodiment, the electronic device 110 may be connected, directly or indirectly, to the additional device 130 (e.g., wireless earphones 131, a smartwatch 132, or smart eyeglasses 133) using short-range wireless communication. For example, the electronic device 110 may output information indicating a state of the electronic device 110 or the wearable device 120 to the user through the additional device 130. For example, feedback information about a walking state of the user wearing the wearable device 120 may be output through a haptic device, a speaker device, and a display device of the additional device 130. The wearable device is configured to be worn by a user.

According to an embodiment, the electronic device 110 may be connected, directly or indirectly, to the server 140 using short-range wireless communication or cellular communication. For example, the server 140 may include a database (DB) in which information about a plurality of exercise programs to be provided to the user through the wearable device 120 is stored. For example, the server 140 may manage a user account of the user of the electronic device 110 or the wearable device 120. The server 140 may store and manage, in association with the user account, an exercise program performed by the user and a result of performing the exercise program. An example configuration of the server 140 will be described in detail below with reference to FIG. 7.

According to an embodiment, the system may provide the user with various exercise programs desired by the user for achieving exercise purposes in various exercise environments. For example, a user's exercise purpose may be set in advance. The exercise purpose may include, for example, at least one of improving muscular strength, improving muscular physical strength, improving cardiovascular endurance, improving core stability, improving flexibility, or improving symmetry.

To achieve the exercise purpose of the user, the system may recommend exercise programs to the user. For example, each exercise program may include one or more exercise modes. For example, each exercise mode may be related to a physical motion for achieving a specific exercise purpose. For example, running may be an exercise mode for improving the cardiovascular endurance of the user. For example, lunge may be an exercise mode for improving the core stability of the user. There may be various combinations of exercise modes included in each exercise program according to the exercise purpose of the user. The system may provide the user with various exercise programs according to a combination of exercise modes, even for the same exercise purpose.

According to an embodiment, an exercise mode may be based on a motion control model that controls the wearable device 120 such that the wearable device 120 is to provide the user with a suitable torque for a target motion of the user. For example, when a first exercise mode is squat, a motion control model for the squat may control the wearable device 120 to provide the user with an assistance force or a resistance force corresponding to a squat posture of the user. For example, when a second exercise mode is left lunge, a motion control model for the left lunge may control the wearable device 120 to provide the user with an assistance force or a resistance force corresponding to a left lunge posture of the user. The motion control model may determine values of control parameters related to a torque to be output from a target motion of the wearable device 120 worn on the user. For example, the control parameters may include parameters for adjusting at least one of a magnitude of a torque to be output through the wearable device 120, a direction of the torque, a timing of the torque, an offset angle between joint angles of the wearable device 120, or a sensitivity of a state factor with respect to the joint angles.

According to an embodiment, a plurality of exercise modes may be databased and stored in the electronic device 110 or in the server 140. The electronic device 110 or the server 140 may generate a plurality of exercise programs based on various sets of information about the user and recommend, to the user, a target exercise program among the exercise programs in consideration of an exercise purpose of the user or an exercise execution state of the user. For example, the electronic device 110 or the server 140 may determine the target exercise program to be recommended to the user based on at least one of an exercise purpose, an exercise history, or an exercise execution result of the user. Accordingly, the user may be recommended for a new exercise program even when doing an exercise daily with the same exercise purpose, and may thereby feel as if performing a different exercise than before by performing the new exercise program.

A method of providing an exercise program to a user will be described in detail below with reference to FIGS. 8 through 16.

Figure 2:
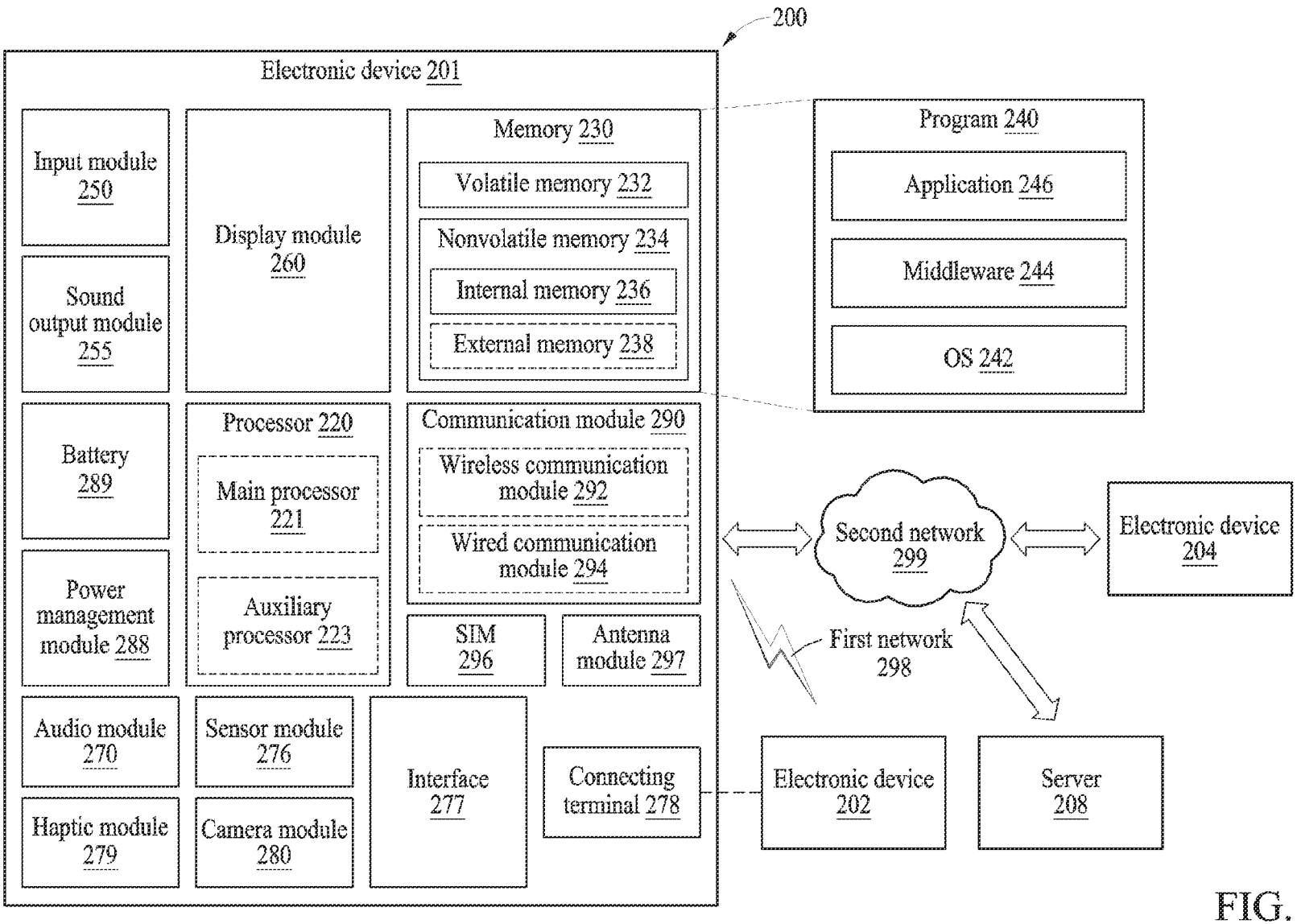
FIG. 2 is a block diagram illustrating an example of an electronic device in a network environment according to an example embodiment.

FIG. 2 is a block diagram illustrating an example of an electronic device in a network environment according to an embodiment.

FIG. 2 is a block diagram illustrating an electronic device 201 (e.g., the electronic device 110 of FIG. 1) in a network environment 200 according to an embodiment. Referring to FIG. 2, the electronic device 201 in the network environment 200 may communicate with an electronic device 202 via a first network 298 (e.g., a short-range wireless communication network), or communicate with at least one of an electronic device 204 and a server 208 via a second network 299 (e.g., a long-range wireless communication network). According to an embodiment, the electronic device 201 may communicate with the electronic device 204 via the server 208. According to an embodiment, the electronic device 201 may include a processor 220, a memory 230, an input module 250, a sound output module 255, a display module 260, an audio module 270, and a sensor module 276, an interface 277, a connecting terminal 278, a haptic module 279, a camera module 280, a power management module 288, a battery 289, a communication module 290, a subscriber identification module (SIM) 296, or an antenna module 297. In an embodiment, at least one (e.g., the connecting terminal 278) of the above components may be omitted from the electronic device 201, or one or more other components may be added to the electronic device 201. In an embodiment, some (e.g., the sensor module 276, the camera module 280, or the antenna module 297) of the components may be integrated as a single component (e.g., the display module 260).

The processor 220 may execute, for example, software (e.g., a program 240) to control at least one other component (e.g., a hardware or software component) of the electronic device 201 connected, directly or indirectly, to the processor 220 and may perform various data processing or computations. According to an embodiment, as at least a part of data processing or computations, the processor 220 may store a command or data received from another component (e.g., the sensor module 276 or the communication module 290) in a volatile memory 232, process the command or data stored in the volatile memory 232, and store resulting data in a non-volatile memory 234. According to an embodiment, the processor 220 may include a main processor 221 (e.g., a central processing unit (CPU) or an application processor (AP)) or an auxiliary processor 223 (e.g., a graphics processing unit (GPU), a neural processing unit (NPU), an image signal processor (ISP), a sensor hub processor, or a communication processor (CP)) that is operable independently from or in conjunction with, the main processor 221. For example, when the electronic device 201 includes the main processor 221 and the auxiliary processor 223, the auxiliary processor 223 may be adapted to consume less power than the main processor 221 or to be specific to a specified function. The auxiliary processor 223 may be implemented separately from the main processor 221 or as a part of the main processor 221.

The auxiliary processor 223 may control at least some of functions or states related to at least one (e.g., the display device/module 260, the sensor module 276, or the communication module 290) of the components of the electronic device 201, instead of the main processor 221 while the main processor 221 is in an inactive (e.g., sleep) state or along with the main processor 221 while the main processor 221 is an active state (e.g., executing an application). According to an embodiment, the auxiliary processor 223 (e.g., an ISP or a CP) may be implemented as a portion of another component (e.g., the camera module 280 or the communication module 290) that is functionally related to the auxiliary processor 223. According to an embodiment, the auxiliary processor 223 (e.g., an NPU) may include a hardware structure specifically for artificial intelligence (AI) model processing. An AI model may be generated by machine learning. The machine learning may be performed by, for example, the electronic device 201, in which the AI model is performed, or performed via a separate server (e.g., the server 208). Learning algorithms may include, but are not limited to, for example, supervised learning, unsupervised learning, semi-supervised learning, or reinforcement learning. The AI model may include a plurality of artificial neural network layers. An artificial neural network may include, for example, a trained and/or trainable deep neural network (DNN), a convolutional neural network (CNN), a recurrent neural network (RNN), a restricted Boltzmann machine (RBM), a deep belief network (DBN), and a bidirectional recurrent deep neural network (BRDNN), a deep Q-network, or a combination of two or more thereof, but is not limited thereto. The AI model may alternatively or additionally include a software structure other than the hardware structure.

The memory 230 may store various pieces of data used by at least one component (e.g., the processor 220 or the sensor module 276) of the electronic device 201. The various pieces of data may include, for example, software (e.g., the program 240) and input data or output data for a command related thereto. The memory 230 may include the volatile memory 232 or the non-volatile memory 234. The nonvolatile memory 234 may include an internal memory 236 and/or an external memory 238.

The program 240 may be stored as software in the memory 230 and may include, for example, an operating system (OS) 242, middleware 244, or an application 246.

The input module 250 may receive, from outside (e.g., a user) the electronic device 201, a command or data to be used by another component (e.g., the processor 220) of the electronic device 201. The input module 250 may include, for example, a microphone, a mouse, a keyboard, a key (e.g., a button), or a digital pen (e.g., a stylus pen).

The sound output module 255 may output a sound signal to the outside of the electronic device 201. The sound output module 255 may include, for example, a speaker or a receiver. The speaker may be used for general purposes, such as playing multimedia or playing a recording. The receiver may be used to receive an incoming call. According to an embodiment, the receiver may be implemented separately from the speaker or as a part of the speaker.

The display module 260 may visually provide information to the outside (e.g., a user) of the electronic device 201. The display module 260 may include, for example, a display, a hologram device, or a projector, and a control circuitry for controlling a corresponding one of the display, the hologram device, and the projector. According to an embodiment, the display module 260 may include a touch sensor adapted to sense a touch, or a pressure sensor adapted to measure an intensity of a force of the touch.

The audio module 270 may convert sound into an electric signal or vice versa. According to an embodiment, the audio module 270 may obtain the sound via the input module 250 or output the sound via the sound output module 255 or an external electronic device (e.g., the electronic device 202, such as a speaker or headphones) directly or wirelessly connected to the electronic device 201.

The sensor module 276 may detect an operational state (e.g., power or temperature) of the electronic device 201 or an environmental state (e.g., a state of a user) external to the electronic device 201 and generate an electric signal or data value corresponding to the detected state. According to an embodiment, the sensor module 276 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 277 may support one or more specified protocols to be used by the electronic device 201 to couple with an external electronic device (e.g., the electronic device 202) directly (e.g., by wire) or wirelessly. According to an embodiment, the interface 177 may include, for example, a high-definition multimedia interface (HDMI), a universal serial bus (USB) interface, a secure digital (SD) card interface, or an audio interface.

The connecting terminal 278 may include a connector via which the electronic device 201 may physically connect to an external electronic device (e.g., the electronic device 202). According to an embodiment, the connecting terminal 278 may include, for example, an HDMI connector, a USB connector, an SD card connector, or an audio connector (e.g., a headphones connector).

The haptic module 279 may convert an electric signal into a mechanical stimulus (e.g., a vibration or a movement) or an electrical stimulus, which may be recognized by a user via their tactile sensation or kinesthetic sensation. According to an embodiment, the haptic module 279 may include, for example, a motor, a piezoelectric element, or an electric stimulator.

The camera module 280, including at least one camera, may capture a still image and moving images. According to an embodiment, the camera module 280 may include one or more lenses, image sensors, ISPs, and flashes.

The power management module 288 may manage power supplied to the electronic device 201. According to an embodiment, the power management module 288 may be implemented as, for example, at least a part of a power management integrated circuit (PMIC).

The battery 289 may supply power to at least one component of the electronic device 201. According to an embodiment, the battery 289 may include, for example, a primary cell, which is not rechargeable, a secondary cell, which is rechargeable, or a fuel cell.

The communication module 290, comprising communication circuitry, may support establishing a direct (e.g., wired) communication channel or a wireless communication channel between the electronic device 201 and an external electronic device (e.g., the electronic device 202, the electronic device 204, or the server 208) and performing communication via the established communication channel. The communication module 290 may include one or more CPs that are operable independently from the processor 220 (e.g., an AP) and that support direct (e.g., wired) communication or wireless communication. According to an embodiment, the communication module 290 may include a wireless communication module 292 (e.g., a cellular communication module, a short-range wireless communication module, or a global navigation satellite system (GNSS) communication module) or a wired communication module 294 (e.g., a local area network (LAN) communication module or a power line communication (PLC) module). A corresponding one of these communication modules may communicate with the external electronic device, for example, the electronic device 204, via the first network 298 (e.g., a short-range communication network, such as Bluetooth™, wireless-fidelity (Wi-Fi) direct, or infrared data association (IrDA)) or the second network 299 (e.g., a long-range communication network, such as a legacy cellular network, a 5G network, a next-generation communication network, the Internet, or a computer network (e.g., a LAN or a wide area network (WAN)). These various types of communication modules may be implemented as a single component (e.g., a single chip), or may be implemented as multiple components (e.g., multiple chips) separate from each other. The wireless communication module 292 may identify and authenticate the electronic device 201 in a communication network, such as the first network 298 and/or the second network 299, using subscriber information (e.g., international mobile subscriber identity (IMSI)) stored in the SIM 296.

The wireless communication module 292 may support a 5G network after a 4G network and next-generation communication technology (e.g., new radio (NR) access technology). The NR access technology may support enhanced mobile broadband (eMBB), massive machine type communications (mMTC), or ultra-reliable and low-latency communications (URLLC). The wireless communication module 292, including communication circuitry, may support a high-frequency band (e.g., a mmWave band) to achieve, e.g., a high data transmission rate. The wireless communication module 292 may support various technologies for securing performance on a high-frequency band, such as, e.g., beamforming, massive multiple-input and multiple-output (MIMO), full dimensional MIMO (FD-MIMO), an antenna array, analog beamforming, or a large-scale antenna. The wireless communication module 292 may support various requirements specified in the electronic device 201, an external electronic device (e.g., the electronic device 204), or a network system (e.g., the second network 299). According to an embodiment, the wireless communication module 292 may support a peak data rate (e.g., 20 Gbps or more) for implementing eMBB, loss coverage (e.g., 164 dB or less) for implementing mMTC, or U-plane latency (e.g., 0.5 ms or less for each of downlink (DL) and uplink (UL), or a round trip of 1 ms or less) for implementing URLLC.

The antenna module 297 may transmit or receive a signal or power to or from the outside (e.g., an external electronic device) of the electronic device 201. According to an embodiment, the antenna module 297 may include an antenna including a radiating element including a conductive material or a conductive pattern formed in or on a substrate (e.g., a printed circuit board (PCB)). According to an embodiment, the antenna module 297 may include a plurality of antennas (e.g., an antenna array). In such a case, at least one antenna appropriate for a communication scheme used in a communication network, such as the first network 298 or the second network 299, may be selected by, for example, the communication module 290 from the plurality of antennas. The signal or power may be transmitted or received between the communication module 290 (including communication circuitry) and the external electronic device via the at least one selected antenna. According to an embodiment, another component (e.g., a radio frequency integrated circuit (RFIC)) other than the radiating element may be additionally formed as a part of the antenna module 297 including at least one antenna.

According to an embodiment, the antenna module 297 (comprising at least one antenna) may form a mmWave antenna module. According to an embodiment, the mmWave antenna module may include a PCB, an RFIC on a first surface (e.g., a bottom surface) of the PCB, or adjacent to the first surface of the PCB and capable of supporting a designated high-frequency band (e.g., a mmWave band), and a plurality of antennas (e.g., an antenna array) disposed on a second surface (e.g., a top or a side surface) of the PCB, or adjacent to the second surface of the PCB and capable of transmitting or receiving signals in the designated high-frequency band.

At least some of the components described above may be coupled mutually and exchange signals (e.g., commands or data) therebetween via an inter-peripheral communication scheme (e.g., a bus, general-purpose input and output (GPIO), a serial peripheral interface (SPI), or a mobile industry processor interface (MIPI)).

According to an embodiment, commands or data may be transmitted or received between the electronic device 201 and the external electronic device (e.g., the electronic device 204) via the server 208 coupled, directly or indirectly, with the second network 299. Each of the external electronic devices (e.g., the electronic device 202 and 204) may be a device of the same type as or a different type from the electronic device 201. According to an embodiment, all or some of operations to be executed by the electronic device 201 may be executed by one or more of the external electronic devices (e.g., the electronic devices 202 and 204, and the server 208). For example, if the electronic device 201 needs to perform a function or a service automatically, or in response to a request from a user or another device, the electronic device 201, instead of, or in addition to, executing the function or the service, may request one or more external electronic devices to perform at least a part of the function or service. The one or more external electronic devices receiving the request may perform the at least part of the function or service requested, or an additional function or an additional service related to the request, and may transfer a result of the performance to the electronic device 201. The electronic device 201 may provide the result, with or without further processing of the result, as at least a part of a response to the request. To that end, cloud computing, distributed computing, mobile edge computing (MEC), or client-server computing technology may be used, for example. The electronic device 201 may provide ultra-low latency services using, e.g., distributed computing or MEC. In an embodiment, the external electronic device (e.g., the electronic device 204) may include an Internet-of-things (IoT) device. The server 208 may be an intelligent server using machine learning and/or a neural network. According to an embodiment, the external electronic device (e.g., the electronic device 204) or the server 208 may be included in the second network 299. The electronic device 201 may be applied to intelligent services (e.g., a smart home, a smart city, a smart car, or healthcare) based on 5G communication technology or IoT-related technology.

According to various embodiments described herein, an electronic device may be a device of one of various types. The electronic device may include, as non-limiting examples, a portable communication device (e.g., a smartphone, etc.), a computing device, a portable multimedia device, a portable medical device, a camera, a wearable device, or a home appliance. However, the electronic device is not limited to the examples described above.

It should be appreciated that various example embodiments of the present disclosure and the terms used therein are not intended to limit the technological features set forth herein to particular embodiments and include various changes, equivalents, or replacements for a corresponding embodiment. In connection with the description of the drawings, like reference numerals may be used for similar or related components. It is to be understood that a singular form of a noun corresponding to an item may include one or more of the things unless the relevant context clearly indicates otherwise. As used herein, "A or B," "at least one of A and B," "at least one of A or B," "A, B, or C," "at least one of A, B, and C," and "A, B, or C," each of which may include any one of the items listed together in the corresponding one of the phrases, or all possible combinations thereof. Terms such as "first," "second," or "initial" or "next" or "subsequent" may simply be used to distinguish the component from other components in question, and do not limit the components in other aspects (e.g., importance or order). It is to be understood that if an element (e.g., a first element) is referred to, with or without the term "operatively" or "communicatively," as "coupled with," "coupled to," "connected with," or "connected to" another element (e.g., a second element), it means that the element may be coupled with the other element directly (e.g., by wire), wirelessly, or via at least at least a third element.

As used in connection with various embodiments of the disclosure, the term "module" may include a unit implemented in hardware, software, or firmware, and may interchangeably be used with other terms, for example, "logic," "logic block," "part," or "circuitry." A module may be a single integral component, or a minimum unit or part thereof, adapted to perform one or more functions. For example, according to an embodiment, the module may be implemented in the form of an application-specific integrated circuit (ASIC). Thus, each "module" herein may comprise circuitry.

Various embodiments set forth herein may be implemented as software (e.g., the program 240) including one or more instructions that are stored in a storage medium (e.g., the internal memory 236 or the external memory 238) that is readable by a machine (e.g., the electronic device 201). For example, a processor (e.g., the processor 220) of the machine (e.g., the electronic device 201) may invoke at least one of the one or more instructions stored in the storage medium and execute it. This allows the machine to be operated to perform at least one function according to the at least one instruction invoked. The one or more instructions may include code generated by a compiler or code executable by an interpreter. The machine-readable storage medium may be provided in the form of a non-transitory storage medium. Here, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to various embodiments, a method according to an example embodiment may be included and provided in a computer program product. The computer program product may be traded as a product between a seller and a buyer. The computer program product may be distributed in the form of a machine-readable storage medium (e.g., a compact disc read-only memory (CD-ROM)), or be distributed (e.g., downloaded or uploaded) online via an application store (e.g., PlayStore™) or between two user devices (e.g., smart phones) directly. If distributed online, at least part of the computer program product may be temporarily generated or at least temporarily stored in the machine-readable storage medium, such as a memory of the manufacturer's server, a server of the application store, or a relay server.

According to various embodiments, each component (e.g., a module or a program) of the components described above may include a single entity or multiple entities, and some of the multiple entities may be separately disposed in different components. According to various embodiments, one or more of the above-described components or operations may be omitted, or one or more other components or operations may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

FIGS. 3A, 3B, 3C, and 3D are diagrams illustrating an example of a wearable device according to an embodiment.

Referring to FIGS. 3A, 3B, 3C, and 3D, a wearable device 300 (e.g., the wearable device 120 of FIG. 1) may be worn on a user to assist the user in walking (and/or gait) more readily. For example, the wearable device 300 may be a device that assists the user in walking (and/or gait). The wearable device 300 may also be an exercise device that not only assists the user in walking but also provides the user with a resistance force to provide the user with an exercise function. For example, the resistance force provided to the user may be a force that is actively applied to the user, such as, for example, a force output by a device such as a motor. For another example, the resistance force may not be the force that is actively applied to the user but a force that hinders a movement or motion of the user, such as, for example, a frictional force. The resistance force may also be referred to as an exercise load.

Although FIGS. 3A, 3B, 3C, and 3D illustrate an example of a hip-type wearable device, a type of the wearable device 300 is not limited to the illustrated hip type, and the wearable device 300 may be provided in a type that supports a whole lower body, supports a portion of the lower body (e.g., a portion of the lower body up to a knee and a portion of the lower body up to an ankle), or supports a whole body.

Although embodiments described below with reference to FIGS. 3A, 3B, 3C, and 3D apply to a hip-type wearable device, the embodiments are not limited to the hip-type wearable device but apply to all types of wearable devices.

According to an embodiment, the wearable device 300 may include a driver 310, a sensor 320, an inertial measurement unit (IMU) 330, a controller 340, a battery 350, and a communication module 352. For example, the IMU 330 and the controller 340 may be arranged in a main frame of the wearable device 300. For another example, the IMU 330 and the controller 340 may be included in a housing (not shown) formed on or attached to the outside of the main frame of the wearable device 300. Each 'controller' herein may comprise processing circuitry.

The driver 310 may include a motor 314 and a motor driver circuit 312 for driving the motor 314. The sensor 320 may include at least one sensor 321. The controller 340 may include a processor 342, a memory 344, and an input interface 346. Although the sensor 321, the motor driver circuit 312, and the motor 314 are shown in FIG. 3C as a single sensor, a single motor driver circuit, and a single motor, respectively, another example 300-1 of the wearable device 300 may include a plurality of sensors 321 and 321-1, a plurality of motor driver circuits 312 and 312-1, and a plurality of motors 314 and 314-1 as shown in FIG. 3D. According to implementation, the wearable device 300 may include a plurality of processors. The number of motor driver circuits, the number of motors, or the number of processors may vary according to a body part on which the wearable device 300 is worn.

The following descriptions of the sensor 321, the motor driver circuit 312, and the motor 314 may also apply to the sensor 321-1, the motor driver circuit 312-1, and the motor 314-1 shown in FIG. 3D.

The driver 310 may drive a hip joint of the user. For example, the driver 310 may be disposed at or near a right hip of the user and/or at or near a left hip of the user. The driver 310 may be additionally disposed at or near knees of the user and at or near ankles of the user. The driver 310 may include the motor 314 configured to generate a rotational torque and the motor driver circuit 312 configured to drive the motor 314.

The sensor 320 may measure an angle of the hip joint (hereinafter also be referred to as a hip joint angle) of the user when the user walks. Here, information related to the hip joint angle sensed by the sensor 320 may include a right hip joint angle, a left hip joint angle, a difference between the right hip joint angle and the left hip joint angle, and a hip joint motion direction. For example, the sensor 321 may be disposed in the driver 310. Based on a position of the sensor 321, the sensor 320 may additionally measure a knee angle of the user and an ankle angle of the user. The sensor 321 may be an encoder. The information related to the hip joint angle measured by the sensor 320 may be transmitted to the controller 340.

According to an embodiment, the sensor 320 may include a potentiometer. The potentiometer may sense an R-axis joint angle and an L-axis joint angle, and an R-axis joint angular velocity and an L-axis joint angular velocity, based on a walking motion of the user. In this case, R and L axes may be reference axes for a right leg and a left leg of the user, respectively. For example, the R and L axes may be set to be vertical to the ground and set such that a front side of a body of a person has a negative value and a rear side of the body has a positive value.

The IMU 330 may measure acceleration information and posture information when the user walks. For example, the IMU 330 may sense an X-axis acceleration, a Y-axis acceleration, and a Z-axis acceleration, and an X-axis angular velocity, a Y-axis angular velocity, and a Z-axis angular velocity, based on a walking motion of the user (e.g., see x, y, and z axes in FIGS. 5 and 6). The acceleration information and the posture information measured by the IMU 330 may be transmitted to the controller 340.

In addition to the sensor 320 and the IMU 330 described above, the wearable device 300 may include other sensors (e.g., an electromyogram (EMG) sensor) configured to sense a change in a quantity of motion of the user or a change in biosignal based on a walking motion of the user.

The controller 340 may control an overall operation of the wearable device 300. For example, the controller 340 may receive the information sensed by each of the sensor 320 and the IMU 330. The information sensed by the IMU 330 may include the acceleration information and the posture information, and the information sensed by the sensor 320 may include the information about the right hip joint angle, the left hip joint angle, the difference between the angles of both hip joints, and the hip joint motion direction. According to an embodiment, the controller 340 may calculate the difference between the angles of both hip joints based on the right hip joint angle and the left hip joint angle. The controller 340 may generate a signal for controlling the driver 310 based on the sensed information. For example, the generated signal may correspond to an assistance force for assisting the user in walking. For another example, the generated signal may correspond to a resistance force for hindering the user from walking. The resistance force may also be provided to the user to assist the user in doing an exercise.

According to an embodiment, the processor 342 of the controller 340 may control the driver 310 to provide the resistance force to the user.

For example, the driver 310 may provide the resistance force to the user by applying an active force to the user through the motor 314. The driver 310 may provide the resistance force to the user by outputting a torque in a direction that hinders a motion of the user.

For example, the driver 310 may provide the resistance force to the user using back-drivability of the motor 314 without applying the active force to the user. The back-drivability of a motor may represent the reactivity of a rotation axis of the motor in response to an external force, and a greater degree of the back-drivability may indicate that the motor may more readily respond to an external force acting on the rotation axis of the motor, that is, the rotation axis of the motor may more readily rotate. For example, even when the same external force is applied to the rotation axis of the motor, a degree of rotation of the rotation axis of the motor may change according to a degree of the back-drivability.

According to an embodiment, the processor 342 of the controller 340 may control the driver 310 such that the driver 310 is to output a torque (and/or an assistance torque) for assisting the user in walking. For example, in the wearable device 300 of a hip type, the driver 310 may be disposed at or near each of the left hip and the right hip of the user, and the controller 340 may output a control signal for controlling the driver 310 to generate a torque.

The driver 310 may generate the torque based on the control signal output by the controller 340. A torque value for generating the torque may be externally set or be set by the controller 340. For example, to indicate a magnitude of the torque value, the controller 340 may use a magnitude of a current for a signal transmitted to the driver 310. That is, as the magnitude of the current received by the driver 310 increases, the torque value may increase. For another example, the processor 342 of the controller 340 may transmit the control signal to the motor driver circuit 312 of the driver 310, and the motor driver circuit 312 may generate a current corresponding to the control signal to control the motor 314.

The battery 350 may supply power to components of the wearable device 300. The wearable device 300 may further include a circuit (e.g., a power management integrated circuit (PMIC)) configured to convert power of the battery 350 to match an operating voltage of the components of the wearable device 300 and provide it to the components of the wearable device 300. In addition, the battery 350 may or may not supply power to the motor 314 based on an operation mode of the wearable device 300.

The communication module 352, including communication circuitry, may support the establishment of a direct (or wired) communication channel or a wireless communication channel between the wearable electronic device 300 and an external electronic device and may support the communication through the established communication channel. The communication module 352 may include one or more communication processors that support direct (or wired) communication or wireless communication. According to an embodiment, the communication module 352 may include a wireless communication module (e.g., a cellular communication module, a short-range wireless communication module, or a global navigation satellite system (GNSS) communication module) or a wired communication module (e.g., a local area network (LAN) communication module or a power line communication (PLC) module). A corresponding one of these communication modules may communicate with an external electronic device over a first network (e.g., a short-range communication network such as Bluetooth, wireless-fidelity (Wi-Fi) direct, or infrared data association (IrDA)) or a second network (e.g., a legacy cellular network, a 5G network, a next-generation communication network, the Internet, or a computer network). These types of communication modules may be integrated into a single component (e.g., a single chip) or different separate components (e.g., a plurality of chips).

Figure 4:
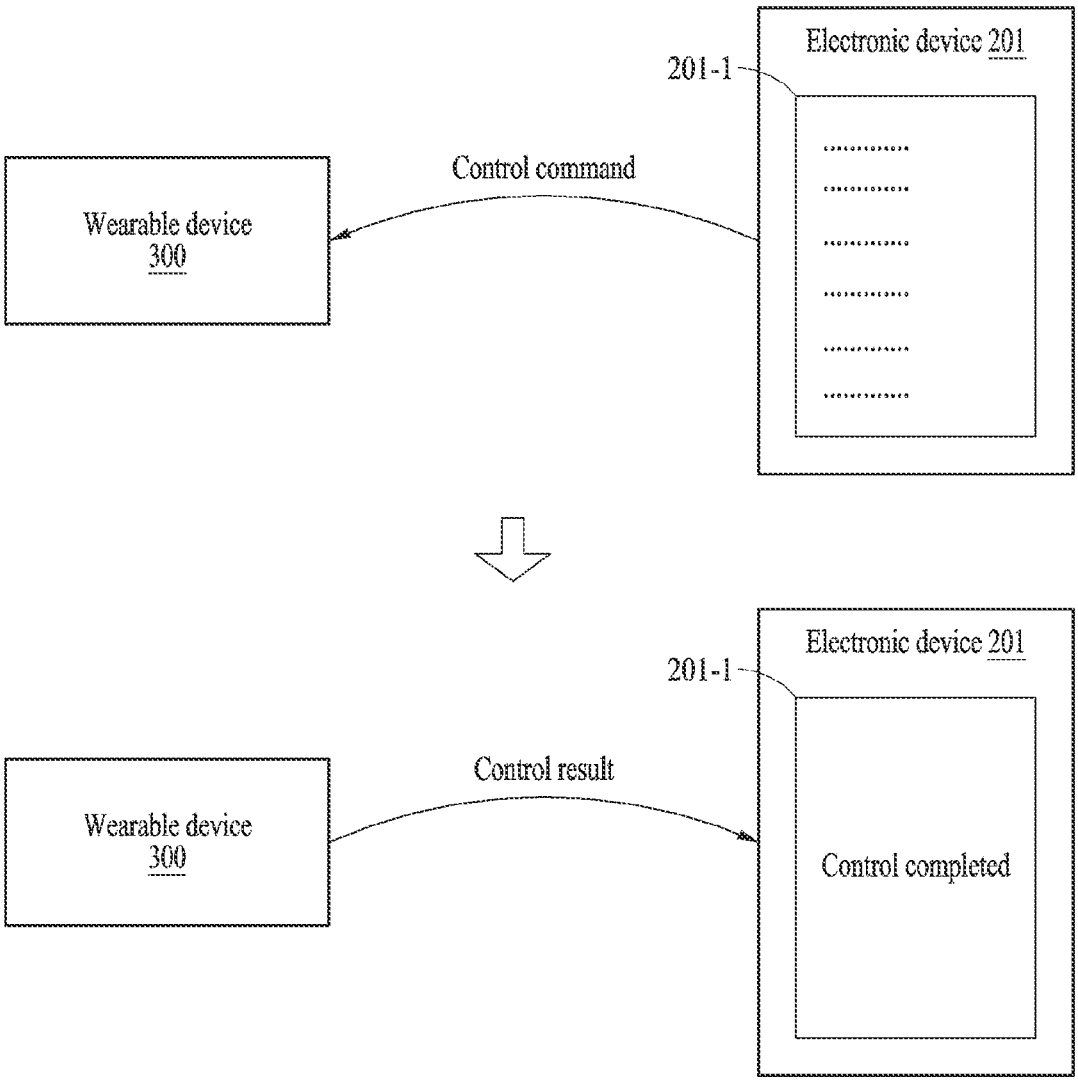
FIG. 4 is a diagram illustrating an example of a wearable device communicating with an electronic device according to an example embodiment.

FIG. 4 is a diagram illustrating an example of a wearable device communicating with an electronic device according to an embodiment.

Referring to FIG. 4, the wearable device 300 may communicate with the electronic device 201. For example, the electronic device 201 may be an electronic device of a user of the wearable device 300. According to an embodiment, the wearable device 300 and the electronic device 201 may be connected through short-range wireless communication.

The electronic device 201 may display, on a display 201-1, a user interface (UI) for controlling operations of the wearable device 300. The UI may include, for example, at least one soft key through which the user may control the wearable device 300.

The user may input a command for controlling the operations of the wearable device 300 through the UI on the display 201-1 of the electronic device 201, and the server 140 (e.g., see FIG. 1) may generate a control command corresponding to the command and transmit the generated control command to the wearable device 300. The wearable device 300 may operate according to the received control command and transmit a control result to the electronic device 201. The electronic device 201 may display a control completion message on the display 201-1 of the electronic device 201.

Figure 5:
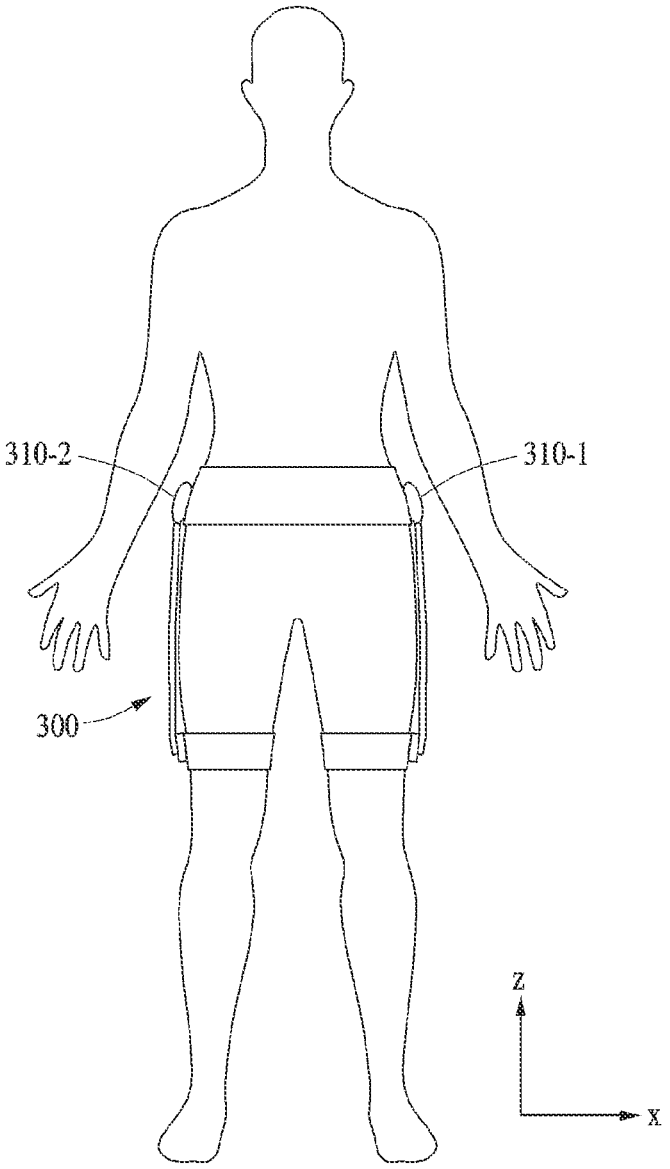
FIGS. 5 and 6 are diagrams illustrating an example of outputting a torque by a wearable device according to an example embodiment.
Figure 6:
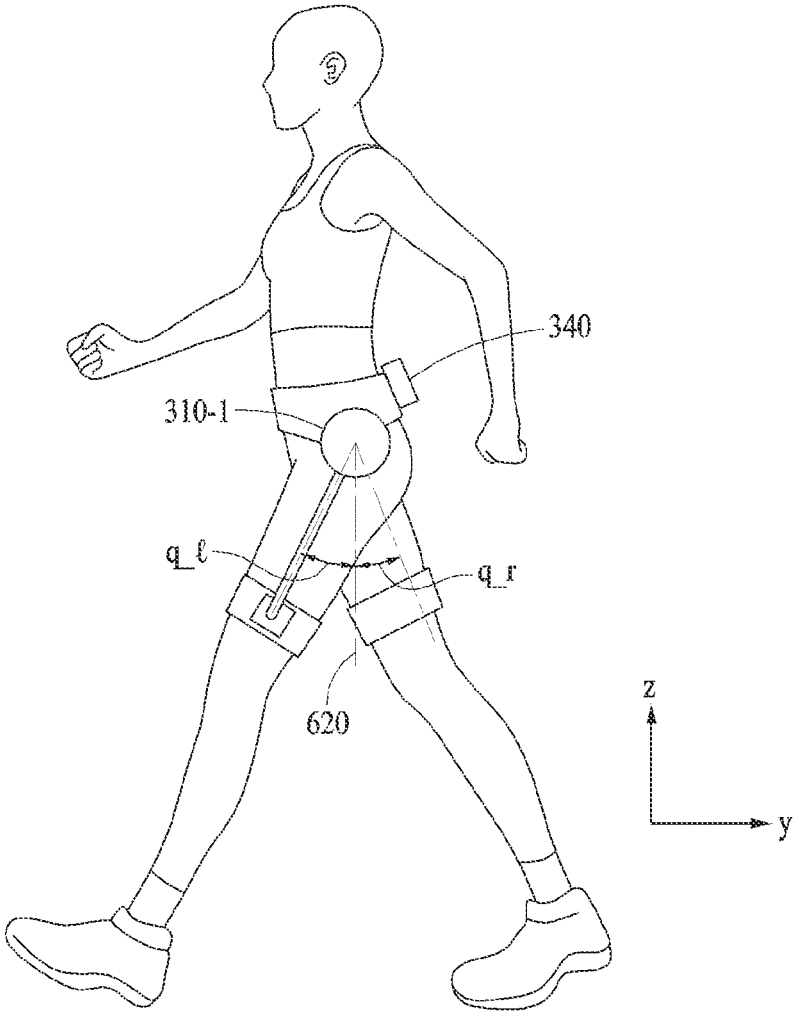

FIGS. 5 and 6 are diagrams illustrating an example of outputting a torque by a wearable device according to an embodiment.

Figure 3A:
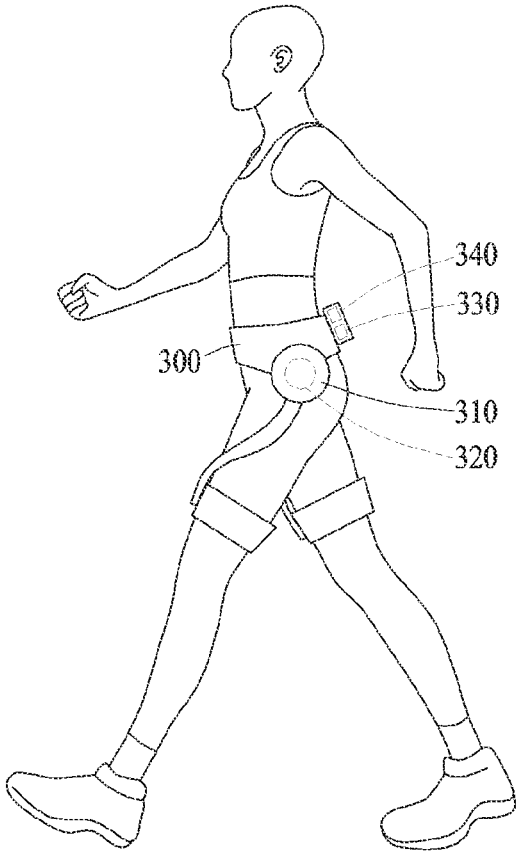
FIGS. 3A, 3B, 3C, and 3D are diagrams illustrating an example of a wearable device according to an example embodiment(s)
Figure 3B:
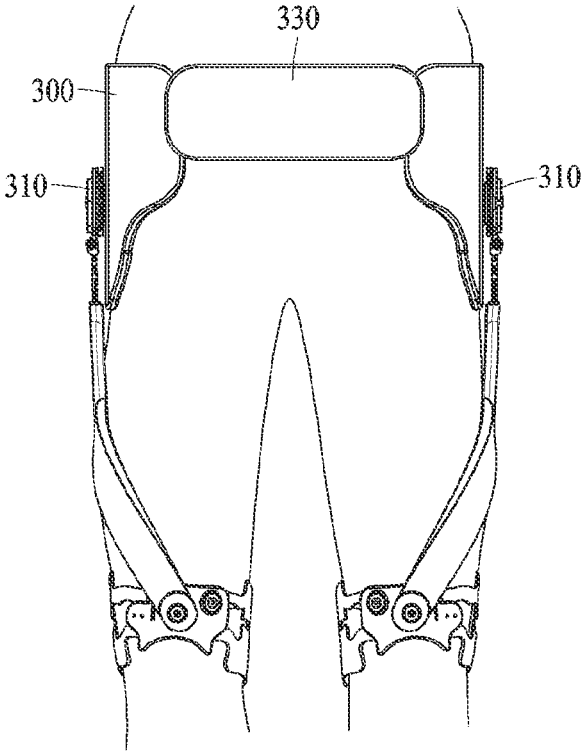
Figure 3C:
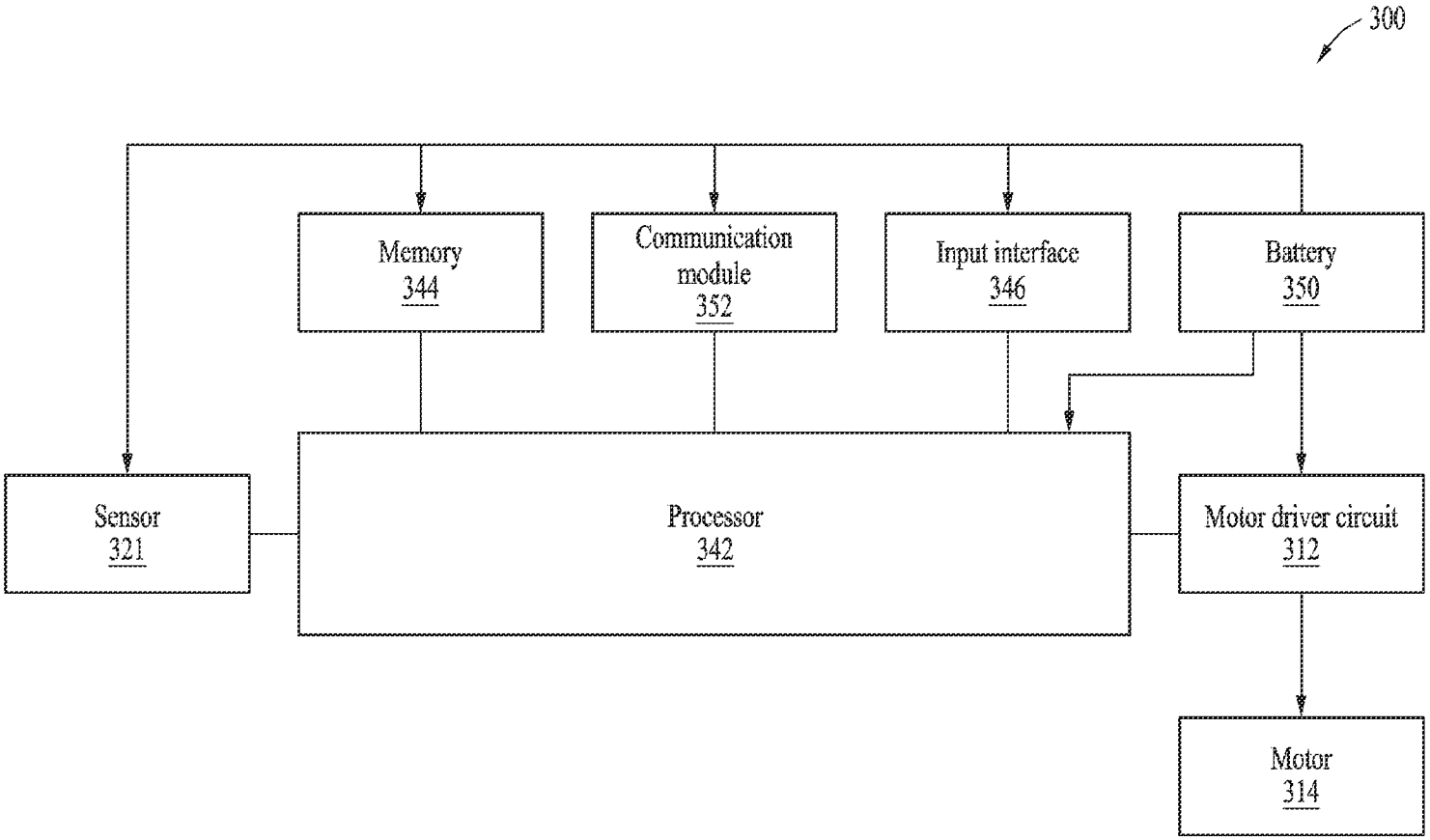
Figure 3D:
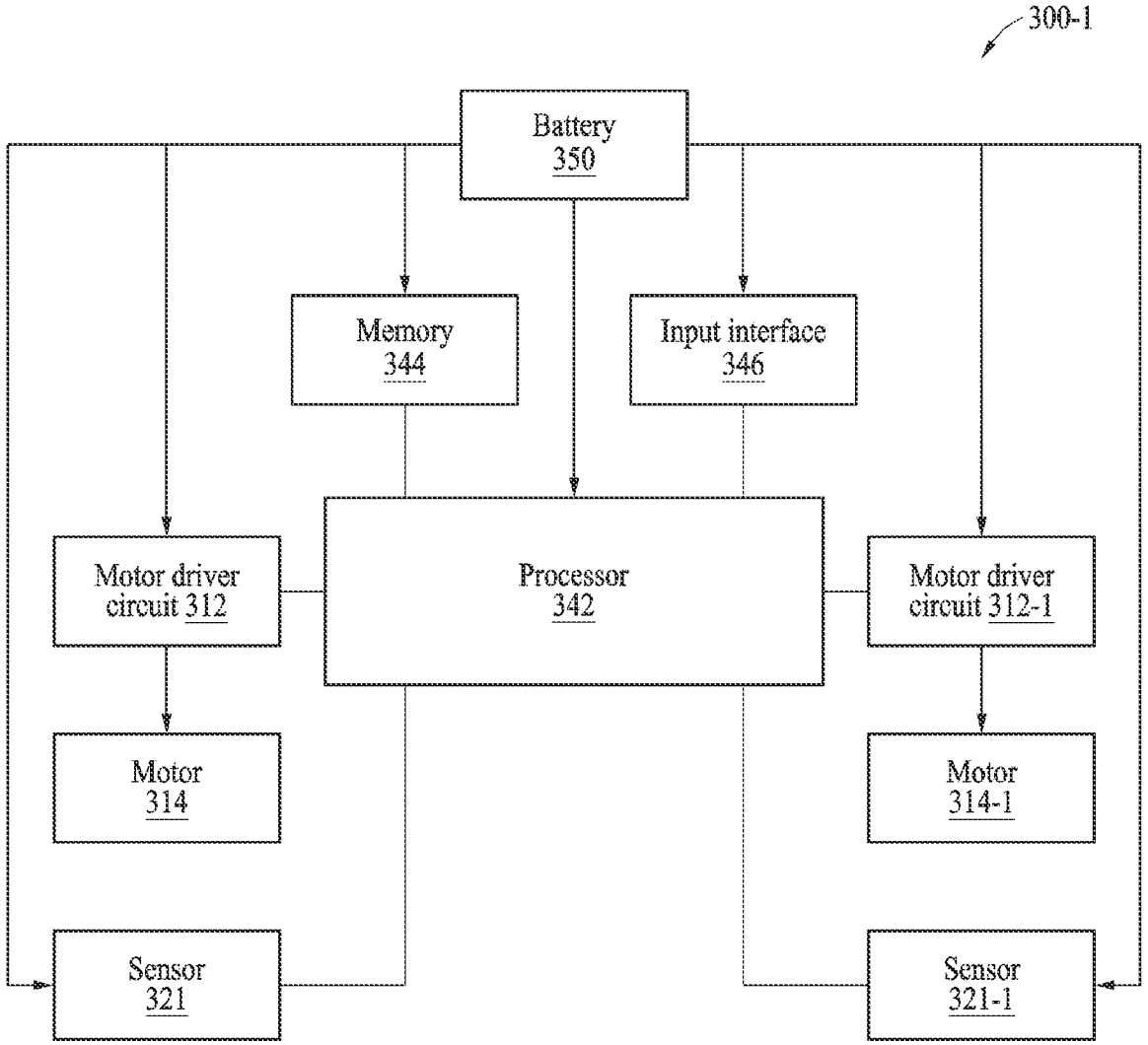

Referring to FIGS. 5 and 6, drivers 310-1 and 310-2 of the wearable device 300 of FIGS. 3A, 3B, and 3C may be disposed at or near a hip joint of a user, and the controller 340 of the wearable device 300 may be disposed at or near a waist of the user. However, the positions of the drivers 310-1 and 310-2 and the controller 340 are not limited to the example positions shown in FIGS. 5 and 6.

The wearable device 300 may measure (and/or sense) a left hip joint angle q_l and a right hip joint angle q_r of the user. For example, the wearable device 300 may measure the left hip joint angle q_l of the user through a left encoder and measure the right hip joint angle q_r of the user through a right encoder. As shown in FIG. 6, the left hip joint angle q_l may be a negative value because a left leg of the user is before a reference line 620, and the right hip joint angle q_r may be a positive value because a right leg of the user is behind the reference line 620. According to implementation, the right hip joint angle q_r may be negative when the right leg is before the reference line 620, and the left hip joint angle q_l may be positive when the left leg is behind the reference line 620.

According to an embodiment, the wearable device 300 may obtain a first angle (e.g., q_r) and a second angle (e.g., q_l) by filtering a first raw angle (e.g., q_r_raw) of a first joint (e.g., a right hip joint) measured by the sensor 320 (e.g., see 321) and a second raw angle (e.g., q_l_raw) of a second joint (e.g., a left hip joint) measured by the sensor 320. For example, the wearable device 300 may filter the first raw angle and the second raw angle based on a previous first angle and a previous second angle that are measured at a previous time.

According to an embodiment, the wearable device 300 may determine a torque value τ(t) based on a left hip joint angle q_l, a right hip joint angle q_r, an offset angle c, a sensitivity α, a gain κ, and a delay Δt, and may control the motor driver circuit 312 of the wearable device 300 such that the determined torque value τ(t) is output. A force to be provided to the user by the torque value τ(t) may be referred to herein as force feedback. For example, the wearable device 300 may determine the torque value τ(t) based on Equation 1 below.

$$y=\sin(q_r)-\sin(q_l)$$

$$\tau(t)=\kappa y(t-\Delta t) \quad \text{[Equation 1]}$$

In Equation 1, y denotes a state factor, and q_r and q_l denote a right hip joint angle and a left hip joint angle, respectively. According to Equation 1, the state factor y may be associated with a distance between both legs. For example, y being zero (0) may indicate a state (e.g., a crossing state) in which the distance between the legs is 0, and an absolute value of y being maximum or high may indicate a state (e.g., a landing state) in which an angle between the legs is maximal or high. When q_r and q_l are measured at a time t, the state factor may be represented as y(t), in this case.

The gain κ is a parameter indicating a magnitude and direction of an output torque. As a magnitude of the gain κ increases, a greater torque may be output. When the gain κ is a negative value, a torque acting as a resistance force may be output to the user. When the gain κ is a positive value, a torque acting as an assistance force may be output to the user. The delay Δt is a parameter associated with a torque output timing. The gain κ and the delay Δt may be preset, and may be adjusted by the user or the wearable device 300. A model that outputs a torque acting as an assistance force to the user based on parameters such as the gain κ and the delay Δt in Equation 1 may be defined as a torque output model (e.g., a torque output algorithm). The wearable device 300 may input, to the torque output model, values of input parameters received through sensors to determine the magnitude and delay of a torque to be output.

According to an embodiment, the wearable device 300 may apply, to a first state factor y(t), a first gain value and a first delay value as parameter values determined for the state factor y(t) to determine a first torque value through Equation 2 below.

$$\tau_l(t)=\kappa y(t-\Delta t)$$

$$\tau_r(t)=-\kappa y(t-\Delta t) \quad \text{[Equation 2]}$$

Since it needs to be applied to both legs, the calculated first torque value may include a value for the first joint and a value for the second joint. For example, $\tau_l(t)$ may be a value for the left hip joint which is the second joint, and $\tau_r(t)$ may be a value for the right hip joint which is the first joint. $\tau_l(t)$ and $\tau_r(t)$ may have the same magnitude and opposite torque directions. The wearable device 300 may control the motor driver circuit 312 of the wearable device 300 such that a torque corresponding to the first torque value is output.

According to an embodiment, when the user performs a gait in which the left leg and the right leg are asymmetrical, the wearable device 300 may provide an asymmetrical torque to each of the legs of the user to assist such an asymmetric gait. For example, the wearable device 300 may provide a greater (and/or stronger) assistance force to a leg with a smaller stride or a slower swing speed. Hereinafter, a leg with a smaller stride or a slower swing speed will be referred to as an affected leg or a target leg.

In general, the affected leg may have a shorter swing time or a smaller stride compared to an unaffected leg. According to an embodiment, to assist the user with their gaits, a method of adjusting a timing of a torque acting on the affected leg may be used. For example, to increase an output time of a torque for assisting the affected leg with a swing motion, an offset angle may be added to an actual joint angle of the affected leg. c is a value of a parameter indicating an offset angle between joint angles. As the offset angle is added to the actual joint angle of the affected leg, a value of an input parameter to be input to the torque output model provided in (and/or applied to) the wearable device 300 may be adjusted. For example, values of q_r and q_l may be adjusted as represented by Equation 3 below. In addition, c r denotes an offset angle for the right hip joint, and ci denotes an offset angle for the left hip joint.

$$q_r(t)\leftarrow q_r(t)+c_r$$

$$q_l(t)\leftarrow q_l(t)+c_l \quad \text{[Equation 3]}$$

According to an embodiment, the wearable device 300 may filter the state factor to reduce discomfort or inconvenience the user may feel due to an irregular torque output. For example, the wearable device 300 may determine an initial state factor $y_{raw}(t)$ of a present time t based on the first angle of the first joint and the second angle of the second joint, and may determine a first state factor y(t) based on a previous state factor $y^{prv}$ determined at a previous time t−1 and the initial state factor $y_{raw}(t)$. The present time t may indicate a time at which data (e.g., sample) is processed, and the previous time t−1 may indicate a time at which t−1 th data is processed. For example, a difference between the present time t and the previous time t−1 may be an operation period of a processor that generates or processes corresponding data. The sensitivity α denotes a value of a parameter indicating sensitivity. For example, a sensitivity value may be continuously adjusted during a test walk, but may be preset as a constant value to reduce the complexity of computation or calculation.

Although it has been described above that the wearable device 300 determines values of control parameters, an electronic device (e.g., the electronic device 110 of FIG. 1 or the electronic device 201 of FIG. 2) may determine the values of the control parameters, instead of the wearable device 300. For example, the electronic device may receive sensing data from the wearable device 300, determine the values of the control parameters based on the sensing data, and control operations of the wearable device 300 based on the determined values of the control parameters.

Figure 7:
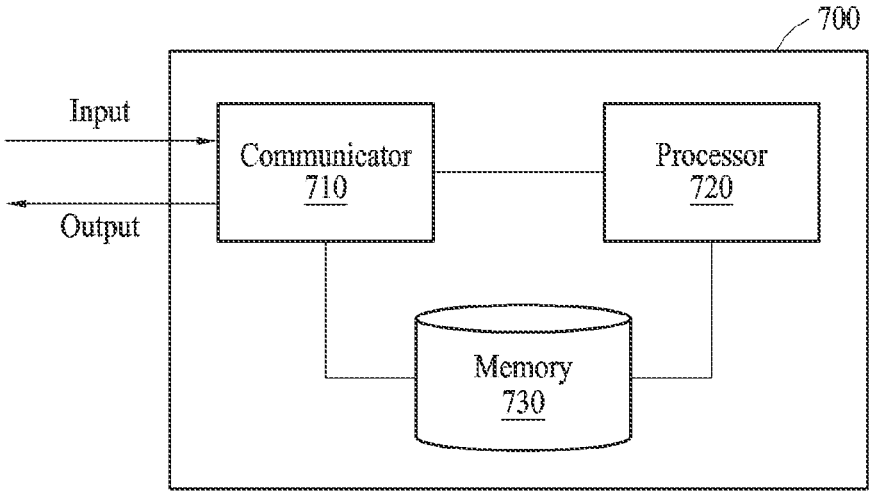
FIG. 7 is a diagram illustrating an example configuration of a server according to an example embodiment.

FIG. 7 is a diagram illustrating an example configuration of a server according to an embodiment.

According to an embodiment, a server 700 may include a communicator 710, a processor 720, and a memory 730. For example, the server 700 may be the server 140 described above with reference to FIG. 1.

The communicator 710 may be connected, directly or indirectly, to the processor 720 and the memory 730 and transmit and receive data thereto and therefrom. The communicator 710 may be connected, directly or indirectly, to another external device and transmit and receive data thereto and therefrom.

The communicator 710 may be implemented as circuitry in the server 700. For example, the communicator 710 may include an internal bus and an external bus. For example, the communicator 710 may be an element that connects the server 700 and an external device. The communicator 710 may be an interface. The communicator 710 may receive data from the external device and transmit the data to the processor 720 and the memory 730.

The processor 720 may process the data received by the communicator 710 and data stored in the memory 730. A "processor" described herein may be a hardware-implemented processing device having a physically structured circuit to execute desired operations. The desired operations may include, for example, code or instructions included in a program. The hardware-implemented data processing device may include, for example, a microprocessor, a central processing unit (CPU), a processor core, a multi-core processor, a multiprocessor, an application-specific integrated circuit (ASIC), and a field-programmable gate array (FPGA).

The processor 720 may execute computer-readable code (e.g., software) stored in a memory (e.g., the memory 730) and instructions triggered by the processor 720.

The memory 730 may store therein the data received by the communicator 710 and the data processed by the processor 720. For example, the memory 730 may store a program (or an application or software). The stored program may be a set of syntaxes coded and executable by the processor 720 to generate a plurality of exercise programs for the user and recommend a target exercise program among the plurality of exercise programs to the user.

According to an embodiment, the memory 730 may include, for example, at least one volatile memory, nonvolatile memory, random-access memory (RAM), flash memory, hard disk drive, and optical disc drive.

The memory 730 may store therein an instruction set (e.g., software) for operating the server 700. The instruction set for operating the server 700 may be executed by the processor 720. According to an embodiment, the memory 730 may include a DB including information about a plurality of exercise modes. According to an embodiment, the memory 730 may include a DB that stores a history of exercise programs performed by a plurality of users.

Figure 8:
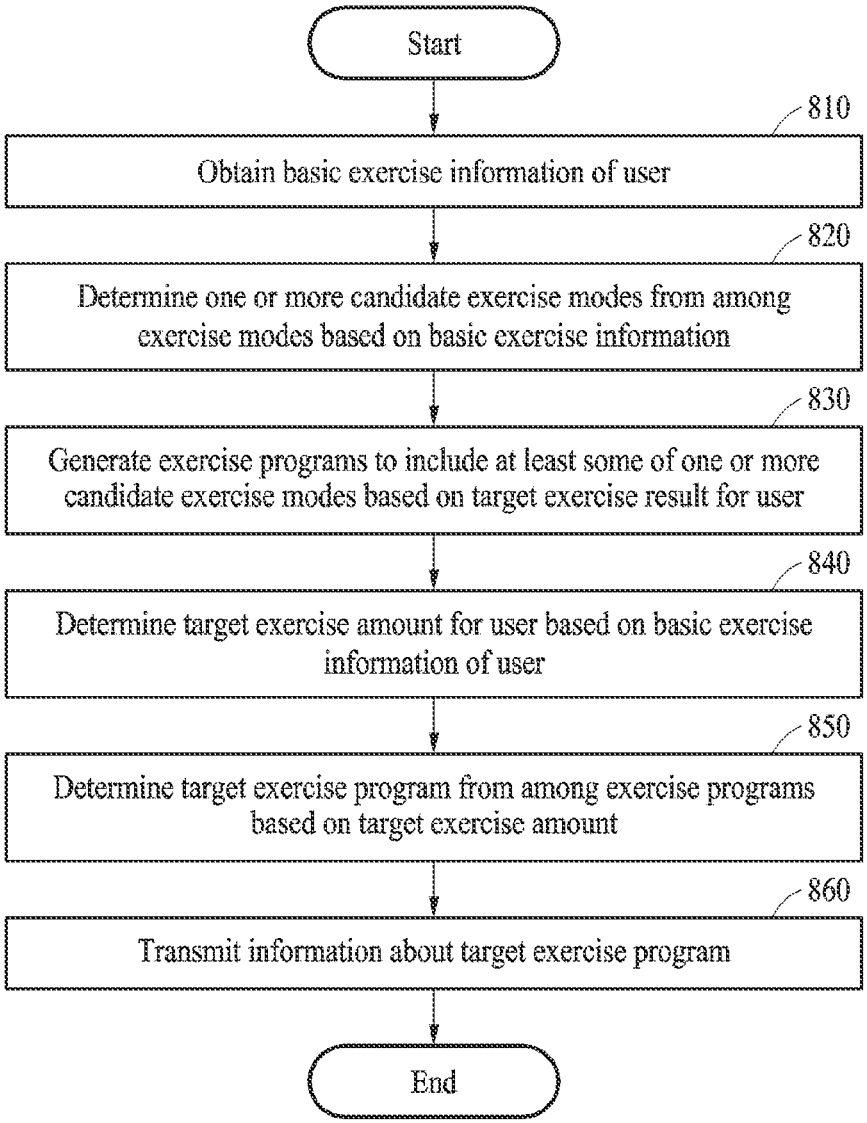
FIG. 8 is a flowchart illustrating an example method of determining an exercise program according to an example embodiment.

FIG. 8 is a flowchart illustrating an example method of determining an exercise program according to an embodiment.

According to an embodiment, operations 810 to 850 described below may be performed by an electronic device (e.g., the electronic device 110 of FIG. 1, the server 140 of FIG. 1, the electronic device 201 of FIG. 2, or the server 700 of FIG. 7). For example, operation 860 described below may be additionally performed after operation 850 is performed, in a case in which the electronic device is a server (e.g., the server 140 of FIG. 1 or the server 700 of FIG. 7).

In operation 810, the electronic device may obtain basic exercise information of a user. The basic exercise information of the user may be user data.

According to an embodiment, the basic exercise information may include physical information of the user. The physical information may include, for example, at least one of gender, age, weight, height, exercise purpose, or disease type of the user.

According to an embodiment, the basic exercise information may be body composition analysis information of the user that is measured by an additional device (e.g., the additional device 130 of FIG. 1) or a wearable device (e.g., the wearable device 120 of FIG. 1 or the wearable device 300 of FIGS. 3A, 3B, and 3C).

According to an embodiment, the basic exercise information may include an exercise ability index. For example, the exercise ability index may be calculated based on sensing data obtained using the wearable device worn on the user. The exercise ability index may include, for example, at least one of peak torque (PT, unit: J/rad), work (W, unit: W), muscular power (MP, unit: W), muscular endurance (ME, unit: repetition (rep)), torque acceleration energy (TAE, unit: J), acceleration time (AT, unit: sec), or a range of motion (RoM, unit: deg). The muscular power refers to a force produced by a muscle for a possible shortest period of time and may be different from muscular strength which refers to a force produced by muscle regardless of time. A method of calculating an exercise ability index of a user will be described in detail below with reference to FIG. 9.

According to an embodiment, the basic exercise information may include user feedback information related to a previous exercise program performed by the user previously. For example, the feedback information may include user satisfaction with the previous exercise program. The feedback information may include, for example, the heart rate of the user that is obtained while the user is performing the previous exercise program. For example, the heart rate of the user may be obtained using an additional device worn on the user (e.g., the smartwatch 132 of FIG. 1).

According to an embodiment, the basic exercise information may include exercise accuracy information related to the previous exercise program that is previously performed by the user. The exercise accuracy information will be described in detail below with reference to FIG. 15.

In operation 820, the electronic device may determine one or more candidate exercise modes from among a plurality of exercise modes based on the basic exercise information.

According to an embodiment, the electronic device may include a DB (e.g., the memory 230 of FIG. 2 or the memory 730 of FIG. 7) including information about each of a plurality of exercise modes. The exercise modes may be distinguished from each other even with the same motion, based on an intensity of a torque provided to a motion of each exercise mode and a speed (tempo) of the motion. For example, squat may be divided into half squat and full squat. In this case, information related to muscle parts used for each exercise mode, an exercise effect, a posture, a metabolic consumption, a calorie consumption, and a level of difficulty may be stored in association with each exercise mode.

According to an embodiment, the electronic device may determine an exercise difficulty level that the user may be able to perform, based on the obtained basic exercise information. The exercise difficulty level may include, for example, a level of a joint motion range of the user, a level of cardiovascular endurance, a level of muscular strength, and the presence or absence of a disease. The electronic device may determine exercise modes suitable for the user as candidate exercise modes based on the exercise difficulty level of the user and information about each of the plurality of exercise modes. A method of determining candidate exercise modes based on a user's exercise difficulty level will be described in detail below with reference to FIG. 10.

In operation 830, the electronic device may generate a plurality of exercise programs to include at least some of the one or more candidate exercise modes based on a target exercise result for the user.

According to an embodiment, the electronic device may generate the target exercise result for the user based on the basic exercise information of the user. For example, the target exercise result may indicate an orientation to which a physical ability is able to be improved. For example, the target exercise result may be a difference between an ideal physical ability and the physical ability of the user. For example, the target exercise result may be determined to further improve a specific physical ability based on the basic exercise information of the user. The target exercise result may include at least one of a muscle part requiring stimulation, a type of exercise effect, or a posture correction. For example, the exercise effect may include at least one of improving muscular strength, improving muscular physical strength, improving cardiovascular endurance, improving core stability, improving flexibility, or improving symmetry.

According to an embodiment, the electronic device may generate a plurality of exercise programs to include at least some of the one or more candidate exercise modes such that the target exercise result is achieved through an exercise program. A method of generating a plurality of exercise programs based on a target exercise result for a user will be described in detail below with reference to FIG. 11.

In operation 840, the electronic device may determine a target exercise amount for the user based on the basic exercise information of the user. For example, the target exercise amount may be a total exercise time recommended for the user to perform during a preset period (e.g., one day or seven days) of time. For example, the target exercise amount may be a total metabolic rate or a calorie that is recommended for the user to consume during a preset period (e.g., one day or seven days) of time. For example, a target calorie for the user may be determined to be a product of a target metabolic rate and a body weight of the user.

According to an embodiment, the electronic device may determine a recommended exercise amount for the user based on the basic exercise information. For example, for an average adult aged 18 to 65, the recommended exercise amount may be determined to be 150 minutes of a moderate-intensity physical activity or 75 minutes of a high-intensity physical activity for a week. The electronic device may determine the target exercise amount based on the recommended exercise amount. For example, the target exercise amount may be represented as a product of an exercise intensity and an exercise time. For example, the target exercise amount may be determined based on a unit of metabolic equivalents (METs) or a unit of calories. For example, when a weekly target exercise amount is determined as 525 METs-min-week, the user may be required to perform a moderate-intensity physical activity of 3.5 METs per min, for 150 minutes in a week.

According to an embodiment, a daily target exercise amount may be determined based on the weekly target exercise amount. For example, the daily target exercise amount may be determined to be a value obtained by dividing the weekly target exercise amount by 7. For example, the daily target exercise amount may be determined differently for each day of the week such that a total sum of daily target exercise amounts is to be an interval target exercise amount.

According to an embodiment, of the weekly target exercise amount, a daily target exercise amount corresponding to a current date may be determined based on a current exercise amount performed by the user in a corresponding period of time. According to this embodiment, when the current exercise amount is relatively small in the corresponding period, the daily target exercise amount may be determined such that an exercise amount for a remaining period is to increase accordingly. A method of determining a current exercise amount performed by a user will be described in detail below with reference to FIG. 13.

In operation 850, the electronic device may determine a target exercise program from among a plurality of exercise programs based on the target exercise amount.

According to an embodiment, an exercise program corresponding to the daily target exercise amount corresponding to the current date may be determined as the target exercise program.

According to an embodiment, the target exercise program may be determined from among the plurality of exercise programs based on the current exercise amount performed by the user within the corresponding period, of the weekly target exercise amount.

According to an embodiment, the electronic device may determine a target exercise effect combination ratio based on the basic exercise information of the user, and determine a target exercise effect amount based on the target exercise effect combination ratio. For example, the target exercise effect combination ratio may be a ratio between effects such as improving muscular strength, improving muscular physical strength, improving cardiovascular endurance, improving core stability, improving flexibility, and improving symmetry. The target exercise effect combination ratio may be determined based on the basic exercise information of the user. For example, the target exercise effect amount may be an amount of an exercise that is achieved by a corresponding target exercise effect. For example, the target exercise effect amount may include 600 METs of an aerobic exercise, 300 METs of an anaerobic exercise (or muscle exercise), and 100 METs of a balance exercise. The electronic device may determine the target exercise program from among the plurality of exercise programs based on the target exercise effect amount. A method of determining a target exercise program based on a target exercise effect amount will be described in detail below with reference to FIG. 12.

According to an embodiment, the electronic device may determine the target exercise program from among the plurality of exercise programs based on the target exercise amount and the target exercise effect amount.

According to an embodiment, when the electronic device is a user terminal (e.g., the electronic device 110 of FIG. 1 or the electronic device 201 of FIG. 2), the electronic device may control the wearable device such that the wearable device is to provide the target exercise program to the user based on information about the target exercise program.

According to an embodiment, when the electronic device is a server (e.g., the server 140 of FIG. 1 or the server 700 of FIG. 7), operation 860 described below may be performed.

In operation 860, when the electronic device is a server, the server may transmit the information about the target exercise program to a user terminal. The user terminal may control the wearable device such that the wearable device is to provide the target exercise program to the user based on the information about the target exercise program.

Figure 9:
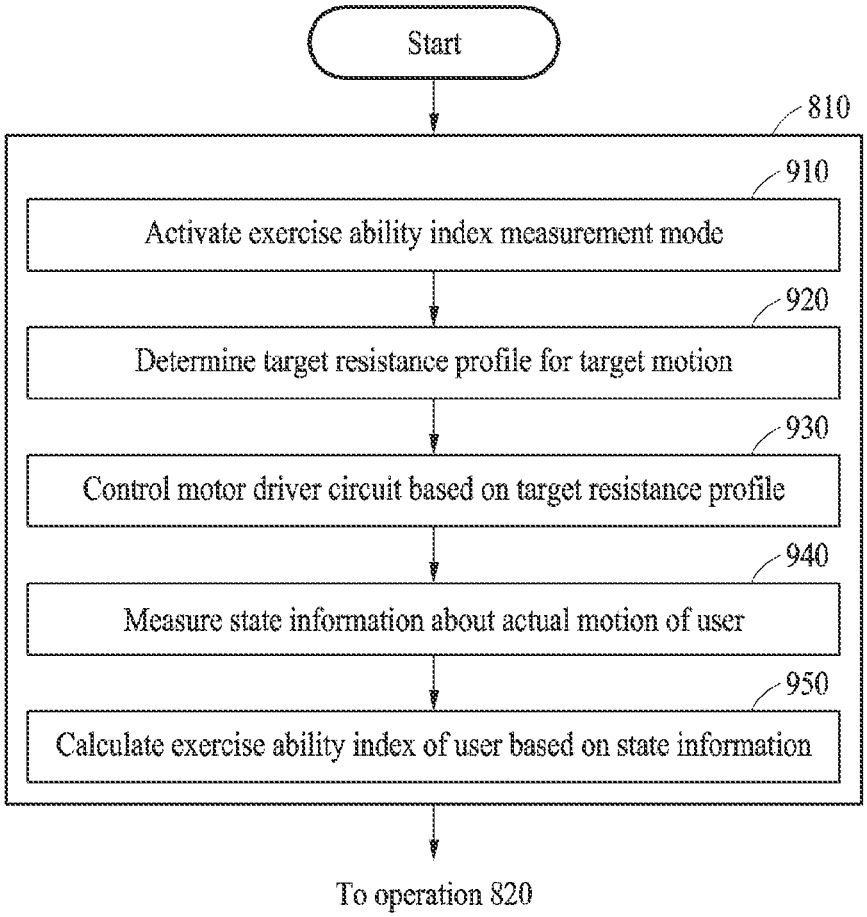
FIG. 9 is a flowchart illustrating an example method of calculating an exercise ability index as basic exercise information of a user according to an example embodiment.

FIG. 9 is a flowchart illustrating an example method of calculating an exercise ability index as basic exercise information of a user according to an embodiment.

According to an embodiment, operation 810 described above with reference to FIG. 8 may include operations 910 to 950 described below.

In operation 910, an electronic device (e.g., the electronic device 110 in FIG. 1, the server 140 in FIG. 1, the electronic device 201 in FIG. 2, or the server 700 in FIG. 7) may activate an exercise ability index measurement mode of a wearable device (e.g., the wearable device 120 of FIG. 1 or the wearable device 300 of FIGS. 3A, 3B, and 3C). For example, when receiving an input for the exercise ability index measurement mode from a user, the electronic device may activate the exercise ability index measurement mode.

In operation 920, the electronic device may determine a target resistance profile for a target motion which is one or more motions to be performed by the user to measure an exercise ability index. For example, the target resistance profile for the target motion may be determined from among a plurality of previously generated resistance profiles.

According to an embodiment, a previously generated resistance profile may indicate a trajectory of a resistance force for an entire exercise ability index measurement cycle. Based on the resistance force profile for the entire exercise ability index measurement cycle, a resistance force corresponding to a current progress of an exercise ability index measurement cycle may be determined. The exercise ability index measurement cycle may be represented as a numeral indicating a series of target motions. When a target motion is repeatedly performed, the exercise ability index measurement cycle may also repeat.

According to an embodiment, the electronic device may determine a target motion to measure an exercise ability index from among one or more target motions. For example, a different target motion may be determined according to a progress of the exercise ability index measurement mode.

For example, a first target motion of the one or more target motions may be knee lifting. In this example, knee lifting may have a posture that starts from a standing upright posture of the user with both feet in contact with the ground and returns to the standing posture after maximally or highly raising a leg backward without bending a waist of the user. A second target motion of the one or more target motions may be stretching a leg behind. In this case, stretching a leg behind may have a posture that starts from a standing upright posture of the user with both hands against a wall and returns to the standing posture after maximally or highly raising a leg backward without bending a waist of the user.

According to an embodiment, the electronic device may determine a target resistance profile from among a plurality of resistance profiles based on a resistance level (e.g., a first level, a second level, a third level, or a fourth level) received from the user. For example, as the received resistance level is higher, a resistance profile with a higher resistance force may be determined.

For example, when the same resistance force needs to be provided to the user during the measurement of the exercise ability index, a resistance force profile with the same resistance force throughout the entire exercise ability index measurement cycle may be determined. For another example, when a resistance force that varies according to the exercise ability index measurement cycle needs to be provided, a resistance force profile in which a resistance force changes according to a progress of the exercise ability index measurement cycle may be determined. The progress of the exercise ability index measurement cycle may be determined based on a time or a joint angle (e.g., a joint angle set) of the user.

In operation 930, the electronic device may control a motor driver circuit of the wearable device based on the target resistance profile to control the resistance force to be provided to the user.

According to an embodiment, the electronic device may determine a ratio between a time for controlling the motor driver circuit to be in a closed loop and a time for controlling the motor driver circuit to be in an open loop based on the target resistance profile, and control the motor driver circuit based on the determined ratio. The resistance force to be provided to the user may vary based on the determined ratio.

For example, the target resistance profile may have a corresponding execution time, and the electronic device may control the motor driver circuit during the execution time. The execution time may be controlled through a timer preset for a target motion.

In operation 940, the electronic device may measure state information about a motion performed by the user under the resistance force provided by the wearable device, through a sensor (e.g., the sensor 320 of FIG. 3A) and/or an IMU (e.g., the IMU 330 of FIG. 3A).

According to an embodiment, the state information may include at least one of one or more joint torques, joint angles, joint angular velocities, or joint angular acceleration values measured by the sensor. The joint angles may include a first angle of a first joint (e.g., a hip joint).

For example, when the target motion is knee lifting, on the wearable device's side, whether the corresponding motion is performed may be determined based on a measured hip joint angle.

According to an embodiment, when knee lifting is performed once, the wearable device may provide feedback to the user. For example, the wearable device may provide auditory feedback to the user through a speaker of the wearable device. For example, the wearable device may provide auditory feedback to the user through a speaker of a user terminal. For example, the wearable device may provide visual feedback to the user through a display of the user terminal. For example, the wearable device may provide tactile feedback to the user through a vibrator of the wearable device.

To measure muscular physical strength, the user may perform knee lifting repeatedly until the timer of the target resistance profile expires.

For example, when the target motion is stretching a leg behind, on the wearable device's side, whether the corresponding motion is performed may be determined based on a measured hip joint angle. When stretching a leg behind is performed once, the wearable device may provide auditory feedback to the user. To measure the exercise ability index, the user may perform stretching a leg behind repeatedly until the timer of the target resistance profile expires.

According to an embodiment, the state information may include at least one of acceleration information and posture information measured by the IMU.

According to an embodiment, while the timer for the execution time of the target resistance profile is running, the state information about a motion of the user may be measured by the sensor and/or the IMU. When the timer expires, the measurement of the state information may also be suspended.

In operation 950, the electronic device may calculate an exercise ability index of the user based on the state information. For example, the electronic device may numerically calculate a plurality of preset indices based on the state information and calculate the exercise ability index based on the calculated indices. The exercise ability index may include, for example, at least one of peak torque (PT), work (W), muscular power (MP), muscular endurance (ME), torque acceleration energy (TAE), acceleration time (AT), or a range of motion. The technique, after operation 950, then proceeds to operation 820 (e.g., see FIG. 8).

According to an embodiment, the exercise ability index may be represented as scores using a predefined equation.

Figure 10:
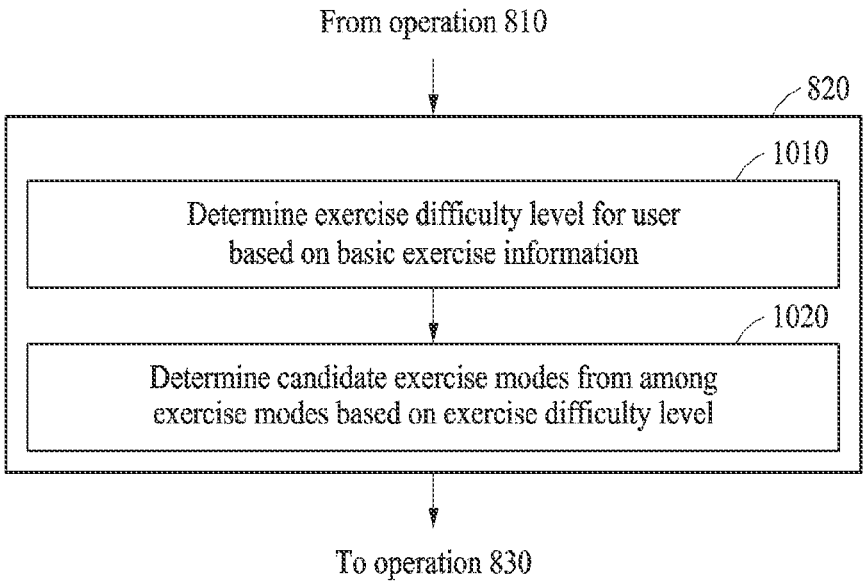
FIG. 10 is a flowchart illustrating an example method of determining candidate exercise modes from among a plurality of exercise modes based on basic exercise information according to an embodiment.

FIG. 10 is a flowchart illustrating an example method of determining candidate exercise modes from among a plurality of exercise modes based on basic exercise information according to an embodiment.

According to an embodiment, operation 820 described above with reference to FIG. 8 may include operations 1010 and 1020 described below. Operations 1010 and 1020 may be performed by an electronic device (e.g., the electronic device 110 of FIG. 1, the server 140 of FIG. 1, the electronic device 201 of FIG. 2, or the server 700 of FIG. 7).

In operation 1010, the electronic device may determine an exercise difficulty level that a user may be able to perform based on obtained basic exercise information. For example, the exercise difficulty level may include at least one of a level of a joint motion range of the user, a cardiovascular endurance level, a muscular strength level, or the presence or absence of a disease.

In operation 1020, the electronic device may determine exercise modes suitable for the user to be candidate exercise modes based on the exercise difficulty level for the user and information about each of a plurality of exercise modes. For example, the electronic device may not determine, to be a candidate exercise mode, an exercise mode that is unsuitable for the user. For example, for a user having a problem with their leg, an exercise mode that requires movements may not be determined to be a candidate exercise mode. For example, for a user with insufficient muscular strength, an exercise mode using a high weight may not be determined to be a candidate exercise mode. The technique, after operation 1020, then proceeds to operation 830 (e.g., see FIG. 8).

Figure 11:
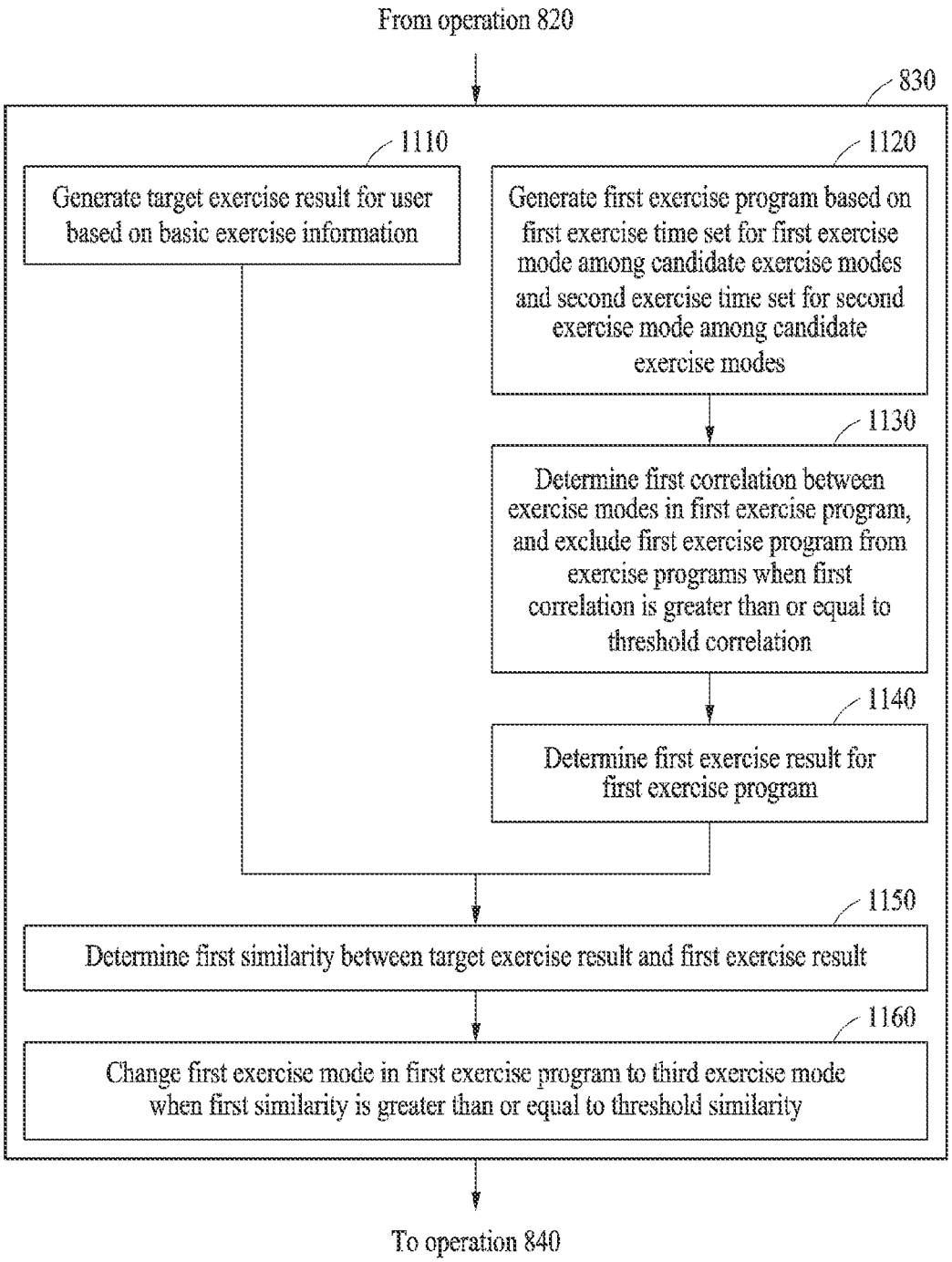
FIG. 11 is a flowchart illustrating an example method of generating a plurality of exercise programs based on a target exercise result for a user according to an example embodiment.

FIG. 11 is a flowchart illustrating an example method of generating a plurality of exercise programs based on a target exercise result for a user according to an embodiment.

According to an embodiment, operation 830 described above with reference to FIG. 8 may include operations 1110 to 1160 described below. Operations 1110 to 1160 may be performed by an electronic device (e.g., the electronic device 110 of FIG. 1, the server 140 of FIG. 1, the electronic device 201 of FIG. 2, or the server 700 of FIG. 7).

In operation 1110, the electronic device may generate a target exercise result for a user based on basic exercise information of the user. For example, the target exercise result may indicate an orientation to which a physical ability of the user is able to be improved. For example, the target exercise result may be a difference between the physical ability of the user and an ideal physical ability. The target exercise result may include at least one of a muscle part requiring stimulation, a type of exercise effect, or posture correction. The exercise effect may include, for example, at least one of improving muscular strength, improving muscular physical strength, improving cardiovascular endurance, improving core stability, improving flexibility, or improving symmetry.

According to an embodiment, the target exercise result may be generated such that an item for an exercise effect that is particularly requested for the user is emphasized.

In operation 1120, the electronic device may generate a first exercise program based on a first exercise time set for a first exercise mode among candidate exercise modes and a second exercise time set for a second exercise mode among the candidate exercise modes. The first exercise mode and the second exercise mode may be the same or different. The electronic device may generate a second exercise program based on a third exercise time set for a third exercise mode among the candidate exercise modes and a fourth exercise time set for a fourth exercise mode among the candidate exercise modes.

According to an embodiment, an attribute of an exercise program to be generated may be set in advance. The attribute of an exercise program may include, for example, at least one of total duration or mobility of the exercise program. For example, the total duration of the exercise program may be 10 minutes, 20 minutes, 30 minutes, 40 minutes, or 60 minutes. For example, the mobility may be whether a corresponding exercise is a dynamic exercise requiring a movement or a static exercise performed in place.

According to an embodiment, when the number of combinations of attributes of an exercise program is N, a plurality of exercise programs for each of the N attribute combinations may be generated. For example, when a first combination corresponds to a static exercise performed for an exercise time of 10 minutes, a first exercise program corresponding to the first combination may include exercise modes all being a static exercise modes and have 10 minutes or less of a total exercise execution time for the exercise modes.

According to an embodiment, the electronic device may determine a structure of the exercise program to be generated. For example, the structure of an exercise program may include a slot for a warm-up exercise, a slot for a main exercise, and a slot for a cool-down exercise. A ratio of each of the warm-up exercise, the main exercise, and the cool-down exercise may be set in advance. For example, when an exercise time of the exercise program is 10 minutes, 1 minute, 8 minutes, and 1 minute may be set in advance for the warm-up exercise, the main exercise, and the cool-down exercise, respectively.

According to an embodiment, an exercise-rest time for the main exercise may be determined in advance. For example, the exercise-rest time for the main exercise may be determined in advance to be of a Tabata type. The Tabata type may be an exercise type performed with one-time pattern having 1 minute of exercise, 1 minute of exercise, and 30 seconds of rest. For example, the exercise-rest time for the main exercise may be determined in advance to be of an interval training type.

According to an embodiment, the electronic device may generate the exercise program by arbitrarily determining an exercise mode for each of a plurality of slots generated according to the structure of the exercise program. For example, when the exercise program has the structure including 1 minute of a warm-up exercise, 8 minutes of a main exercise, and 1 minute of a cool-down exercise, and has a Tabata-type exercise-rest structure, three times of repetition of an exercise-rest pattern which lasts 2 minutes and 30 seconds may be set for the 8 minutes of the main exercise and the remaining 30 seconds may not be used. The exercise time of the exercise program generated according to the foregoing example may be 9 minutes and 30 seconds in total. Unlike the foregoing example, the remaining 30 seconds may be added to the warm-up exercise or the cool-down exercise and, in this case, the exercise time of the exercise program to be generated may be 10 minutes in total.

The exercise program of the foregoing example may include a total of 8 slots, and any exercise mode may be determined for each of the 8 slots. For example, an exercise mode among dynamic stretching exercise modes may be determined for the slot for the warm-up exercise. For example, an exercise mode among static stretching exercise modes may be determined for the slot for the cool-down exercise. For example, any exercise modes of the same type (e.g., a dynamic type requiring mobility or a static type without mobility) may be determined for the slot for the main exercise.

In operation 1130, the electronic device may determine a first correlation between exercise modes in the generated first exercise program, and exclude the first exercise program from a plurality of exercise programs when the first correlation is greater than or equal to a threshold correlation. For example, a correlation between a half squat exercise mode and a full squat exercise mode may be calculated to be relatively high. A high correlation between the exercise modes included in the first exercise program may indicate that the first exercise program includes similar exercise modes. For example, when the user performs similar exercises, the user may feel bored. To prevent or reduce the chances of the user from feeling bored, an exercise program having a high correlation between exercise modes may be excluded from a recommended exercise program.

According to an embodiment, when the first correlation for the first exercise program is less than the threshold correlation, operation 1140 described below may be performed.

In operation 1140, the electronic device may determine a first exercise result for the first exercise program.

According to an embodiment, the electronic device may determine the first exercise result based on information about each of the exercise modes of the first exercise program. The first exercise result may include, for example, a degree of muscular stimulation, a degree of exercise effect, or a degree of posture correction, which may be predicted when the user performs the first exercise program. For example, the first exercise result may be adjusted based on the exercise-rest structure set for the first exercise program.

In operation 1150, the electronic device may determine a first similarity between the target exercise result and the first exercise result. For example, a similarity between each of elements constituting the target exercise result and each of elements constituting the first exercise result may be calculated.

According to an embodiment, when the first similarity is less than a threshold similarity, the electronic device may exclude the first exercise program from the plurality of exercise programs.

In operation 1160, when the first similarity is greater than or equal to the threshold similarity, the electronic device may change a first exercise mode in the first exercise program to a third exercise mode. The third exercise mode may be any exercise mode. The technique, after operation 1160, then proceeds to operation 840 (e.g., see FIG. 8).

According to an embodiment, the electronic device may change a preset number (or ratio) of exercise modes among the exercise modes in the first exercise program to any other exercise modes.

According to an embodiment, the electronic device may determine one or more exercise programs having a high similarity to the target exercise result from among the plurality of exercise programs, and change a preset number (or ratio) of exercise modes of each of the determined exercise programs to any other exercise modes.

According to an embodiment, the electronic device may update the plurality of exercise programs by repeatedly performing operations 1120 to 1160.

According to an embodiment, the electronic device may rearrange the order of the exercise modes in the first exercise program among the plurality of exercise programs generated through operations 1120 to 1160. For example, the order of the exercise modes may be adjusted such that an exercise mode with a relatively small exercise amount is performed before an exercise mode with a relatively large exercise amount. For example, the order of the exercise modes may be adjusted such that exercise modes corresponding to each other, for example, a left lunge exercise mode and a right lunge exercise mode, are performed in succession. For example, the order of the exercise modes may be adjusted (e.g., adjusted such that the exercise modes are arranged as farthest as possible from each other) such that similar exercise modes, for example, a half squat exercise mode and a full squat exercise mode, are performed not in succession.

Figure 12:
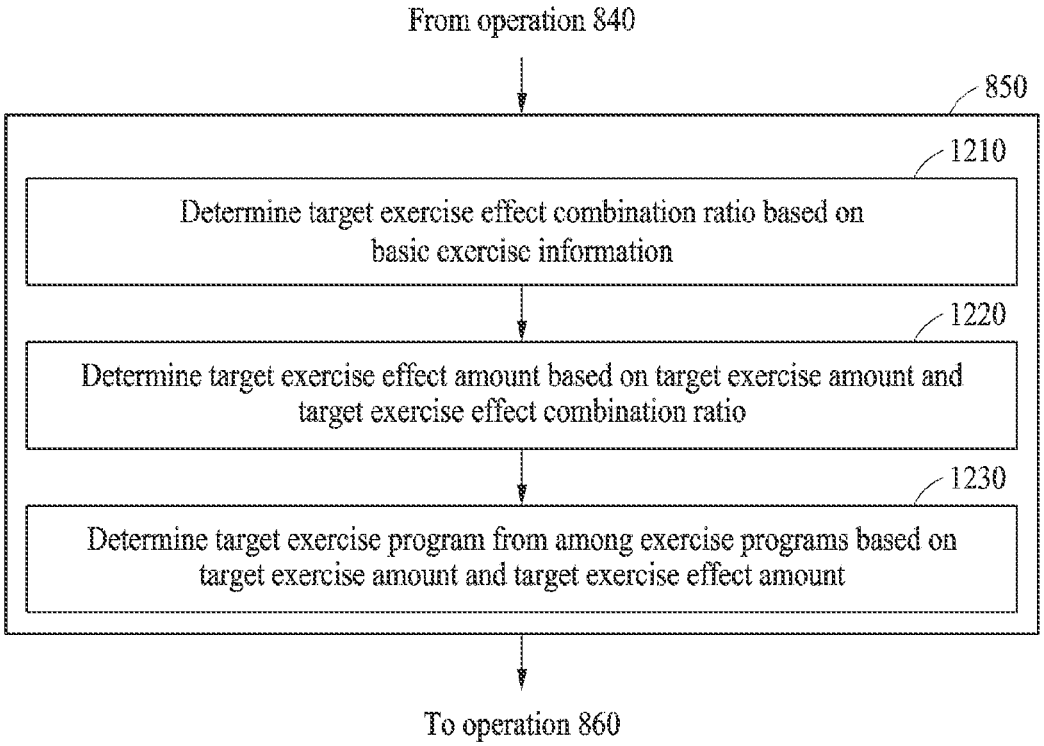
FIG. 12 is a flowchart illustrating an example method of determining a target exercise program from among a plurality of exercise programs based on a target exercise amount for a user according to an example embodiment.

FIG. 12 is a flowchart illustrating an example method of determining a target exercise program from among a plurality of exercise programs based on a target exercise amount for a user according to an embodiment.

According to an embodiment, operation 850 described above with reference to FIG. 8 may include operations 1210, 1220, and 1230 described below. Operations 1210, 1220, and 1230 may be performed by an electronic device (e.g., the electronic device 110 of FIG. 1, the server 140 of FIG. 1, the electronic device 201 of FIG. 2, or the server 700 of FIG. 7).

In operation 1210, the electronic device may determine a target exercise effect combination ratio based on basic exercise information. For example, the target exercise effect combination ratio may be a ratio of exercise effects requested for a user among a plurality of predefined exercise effects. For example, the target exercise effect combination ratio may be a ratio among an effect of improving muscular strength, an effect of improving muscular physical strength, an effect of improving cardiovascular endurance, an effect of improving core stability, an effect of improving flexibility, and an effect of improving symmetry. The target exercise effect combination ratio may be determined such that an item for an exercise effect particularly requested for the user is emphasized.

In operation 1220, the electronic device may determine a target exercise effect amount based on a target exercise amount and the target exercise effect combination ratio. For example, the target exercise effect amount for each exercise effect may be calculated by dividing the target exercise amount by the target exercise effect combination ratio. For example, when the target exercise effect combination ratio for an aerobic exercise, an anaerobic exercise (e.g., a muscle exercise), and a balance exercise is 6:3:1 and a weekly target exercise effect amount is 1000 METs, the weekly target exercise effect amount may be calculated to be 600 METs for the aerobic exercise, 300 METs for the anaerobic exercise, and 100 METs for the balance exercise.

According to an embodiment, a daily target exercise effect amount may be determined based on the weekly target exercise effect amount. For example, the daily target exercise effect amount may be determined by a value obtained by dividing the weekly target exercise effect amount by 7. For example, the daily target exercise effect amount may be determined differently for each day of the week such that a total sum of daily target exercise effect amounts is to be an interval target exercise effect amount.

According to an embodiment, of the weekly target exercise effect amount, a daily target exercise effect amount corresponding to a current date may be determined based on a current exercise effect amount of an exercise performed by the user within a corresponding period of time. According to this embodiment, when the current exercise effect amount is relatively small in the corresponding period, the daily target exercise effect amount may be determined so as to increase the exercise effect amount for the remaining period. A method of determining a current exercise effect amount performed by a user will be described in detail below with reference to FIG. 13.

In operation 1230, the electronic device may determine a target exercise program from among a plurality of exercise programs based on the target exercise amount and/or the target exercise effect amount. For example, the electronic device may determine, to be the target exercise program, an exercise program having a predicted exercise amount and a predicted exercise effect amount that are most similar to the target exercise amount and the target exercise effect amount, respectively. The technique, after operation 1230, then proceeds to operation 860 (e.g., see FIG. 8).

According to an embodiment, the electronic device may calculate a predicted exercise amount and a predicted exercise effect amount for each of the plurality of exercise programs and select, as the target exercise program, an exercise program having a predicted exercise amount and a predicted exercise effect amount that are respectively most similar to the target exercise amount and the target exercise effect amount. For example, the electronic device may calculate a sub-exercise amount and a sub-exercise effect amount for each of one or more exercise modes included in an exercise program, calculate a total sum of sub-exercise amounts to be a predicted exercise amount, and calculate a total sum of sub-exercise effect amounts to be a predicted exercise effect amount. For example, the sub-exercise amounts and the sub-exercise effect amounts for the respective exercise modes may be preset and stored in a DB. For example, the predicted exercise amount and the predicted exercise effect amount may be adjusted based on a structure of an exercise program.

According to an embodiment, the target exercise program may be determined for each exercise program attribute. For example, a target exercise program for a dynamic exercise (which involves mobility) may be determined, and a target exercise program for a static exercise (which is performed in place) may be determined. For example, a target exercise program for a 10-minute exercise may be determined, and a target exercise program for a 20-minute exercise may be determined.

Figure 13:
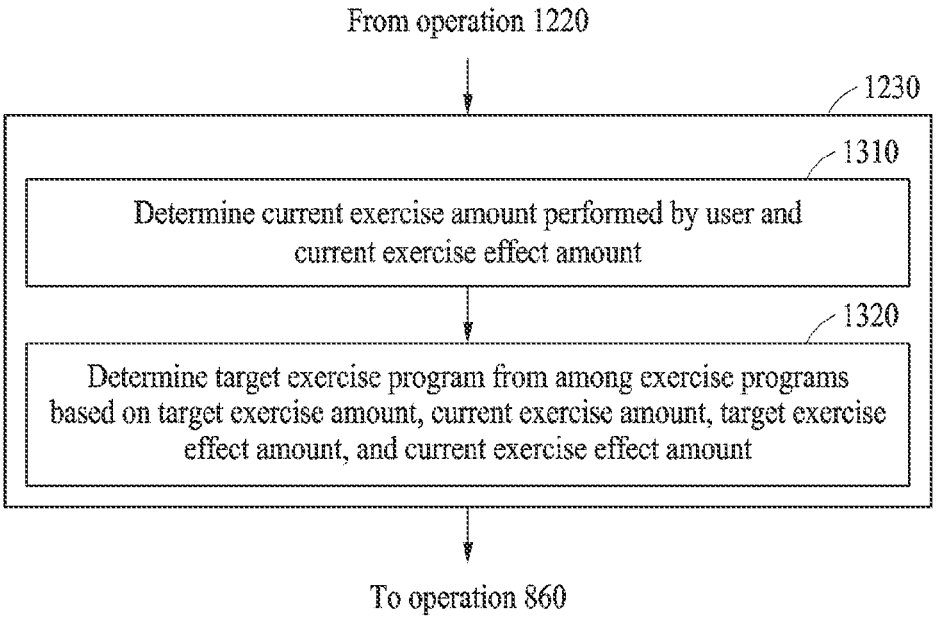
FIG. 13 is a flowchart illustrating an example method of determining a target exercise program from among a plurality of exercise programs based on a current exercise amount and a current exercise effect amount of an exercise performed by a user according to an example embodiment.

FIG. 13 is a flowchart illustrating an example method of determining a target exercise program from among a plurality of exercise programs based on a current exercise amount performed by a user and a current exercise effect amount according to an embodiment.

According to an embodiment, operation 1230 described above with reference to FIG. 12 may include operations 1310 and 1320 described below. Operations 1310 and 1320 may be performed by an electronic device (e.g., the electronic device 110 of FIG. 1, the server 140 of FIG. 1, the electronic device 201 of FIG. 2, or the server 700 of FIG. 7).

In operation 1310, the electronic device may determine a current exercise amount and a current exercise effect amount of an exercise performed by the user.

According to an embodiment, the electronic device may determine the current exercise amount and the current exercise effect amount of the exercise performed by the user wearing a wearable device through exercise programs. For example, the electronic device may calculate a first sub-current exercise amount and a first sub-current exercise effect amount which are associated with the execution of a first exercise mode, by multiplying, by the number of actual exercise executions, an exercise amount and an exercise effect amount which are set in advance for a one-time motion of the first exercise mode of a first exercise program. In this example, a sum of sub-current exercise amounts and a sum of sub-current exercise effect amounts for exercise modes of the first exercise program may be calculated to be a first current exercise amount and a first current exercise effect amount for the first exercise program. When the user has performed a plurality of exercise programs in a corresponding period of time, the current exercise amount and the current exercise effect amount for the plurality of exercise programs may be determined.

According to an embodiment, the electronic device may determine the current exercise amount and the current exercise effect amount performed by the user wearing the wearable device, without using the exercise programs. For example, when the user moves with the wearable device worn on the user, the current exercise amount and the current exercise effect amount for the corresponding movement may be determined. For example, when the wearable device operates in a mode (e.g., a freestyle exercise mode) providing a basic resistance force to a motion of the user, the current exercise amount and the current exercise effect amount may be determined based on the basic resistance force and the motion of the user.

According to an embodiment, the electronic device may determine a current exercise amount and a current exercise effect amount of an exercise performed by a user who is not wearing a wearable device. For example, the current exercise amount and the current exercise effect amount for a motion of the user may be determined based on gait data of the user that is measured through an external application (e.g., health app) installed on the electronic device that is a user terminal of the user. For example, when, for a walking exercise, 3 METs-min of an exercise amount is preset and 80% of an aerobic exercise effect is preset, the current exercise amount may be determined to be 180 METs for the walking exercise performed by the user for 60 minutes and the current exercise amount for the aerobic exercise may be determined to be 144 METs.

In operation 1320, the electronic device may determine the target exercise program from among the plurality of exercise programs based on the target exercise amount, the current exercise amount, the target exercise effect amount, and the current exercise effect amount. The technique, after operation 1320, then proceeds to operation 860 (e.g., see FIG. 8).

For example, the electronic device may determine a value obtained by subtracting a daily current exercise amount from a daily target exercise amount to be a corrected daily target exercise amount, and determine a target exercise program corresponding to the corrected daily target exercise amount. For example, the electronic device may determine a value obtained by subtracting the daily current exercise effect amount from the daily target exercise effect amount to be a corrected daily target exercise effect amount, and determine a target exercise program corresponding to the corrected daily target exercise effect amount.

Figure 14:
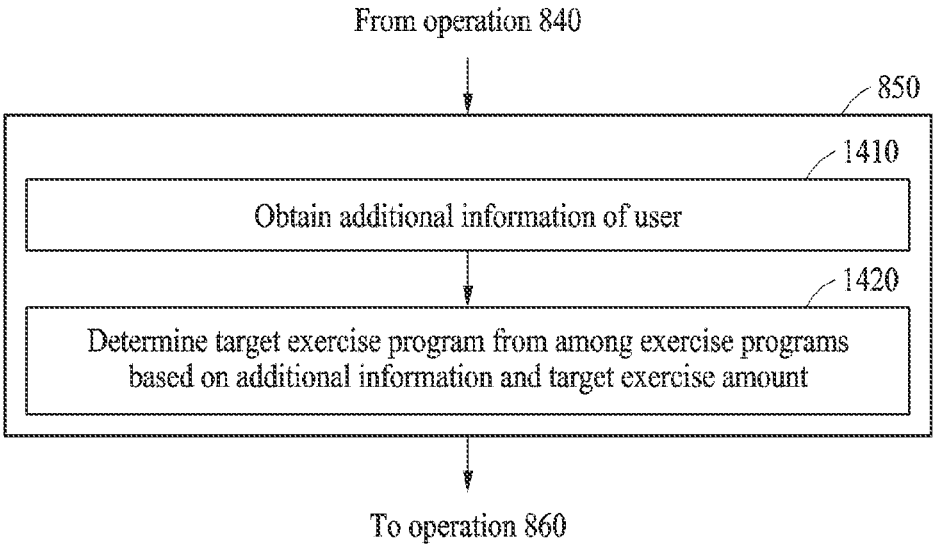
FIG. 14 is a flowchart illustrating an example method of determining a target exercise program from among a plurality of exercise programs based on additional information of a user according to an example embodiment.

FIG. 14 is a flowchart illustrating an example method of determining a target exercise program from among a plurality of exercise programs based on additional information of a user according to an embodiment.

According to an embodiment, operation 850 described above with reference to FIG. 8 may include operations 1410 and/or 1420 described below of FIG. 14. Operations 1410 and 1420 may be performed by an electronic device (e.g., the electronic device 110 of FIG. 1, the server 140 of FIG. 1, the electronic device 201 of FIG. 2, or the server 700 of FIG. 7).

In operation 1410, the electronic device may obtain additional information of a user. For example, the additional information may be information obtained from an external server, an external electronic device, or a wearable device (e.g., the wearable device 120 of FIG. 1 or the wearable device 300 of FIGS. 3A, 3B, and 3C).

According to an embodiment, the additional information may include at least one of weather information related to a location of the user (and/or a user terminal or the wearable device) or a current time. For example, the weather information may include at least one of precipitation, outdoor temperature, fine dust level, or wind volume. For example, the current time may include at least one of date, day, and time.

According to an embodiment, the additional information may include information related to mobility of the user. For example, this mobility-related information may be received from the wearable device. For example, the mobility-related information may include information as to whether the user is currently walking, running, or not moving.

In operation 1420, the electronic device may determine a target exercise program from among a plurality of exercise programs based on the additional information and a target exercise amount.

According to an embodiment, the electronic device may exclude an exercise program that does not correspond to the additional information from the plurality of exercise programs. For example, when it is raining, an exercise program corresponding to an outdoor exercise may be excluded from the plurality of exercise programs.

The electronic device may determine the target exercise program from among a plurality of exercise programs corresponding to the additional information. For example, when it is raining, an exercise program corresponding to an indoor exercise may be determined to be the target exercise program. For example, when it is currently late in the evening, an exercise program with a relatively low exercise intensity may be determined to be the target exercise program in consideration of sound sleep for the user. For example, when it is the weekend, a dynamic exercise program (involving mobility) that is performed outdoors may be determined to be the target exercise program. For example, when the user is walking, the dynamic exercise program for the user may be determined to be the target exercise program.

Figure 15:
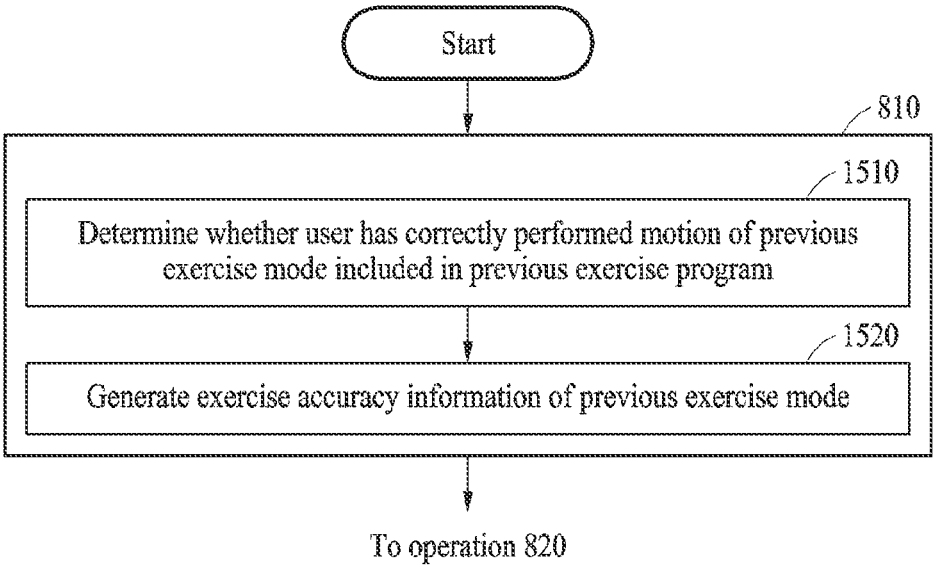
FIG. 15 is a flowchart illustrating an example method of generating exercise accuracy information of a previous exercise mode as basic exercise information of a user according to an example embodiment.

FIG. 15 is a flowchart illustrating an example method of generating exercise accuracy information of a previous exercise mode as basic exercise information of a user according to an embodiment.

According to an embodiment, operation 810 described above with reference to FIG. 8 may include operations 1510 and 1520 to be described hereinafter. Operations 1510 and 1520 may be performed by an electronic device (e.g., the electronic device 110 of FIG. 1, the server 140 of FIG. 1, the electronic device 201 of FIG. 2, or the server 700 of FIG. 7).

In operation 1510, the electronic device may determine whether the user has correctly performed a motion of a previous exercise mode included in a previous exercise program.

According to an embodiment, the electronic device may determine whether the user has correctly performed the motion of the previous exercise mode included in the previous exercise program based on sensing data generated by a wearable device. For example, when the previous exercise mode is full squat, the electronic device may determine whether a posture of the motion performed by the user corresponds to the full squat based on the sensing data. For example, when the posture of the motion performed by the user corresponds to the full squat, the number of attempts at the motion and the number of correct executions of the motion may each be increased by one. For example, when the posture of the motion performed by the user does not correspond to the full squat, the number of attempts at the motion may be increased by one and the number of correct executions of the motion may not be increased.

In operation 1520, the electronic device may generate exercise accuracy information of the previous exercise mode.

According to an embodiment, a ratio of the number of correct executions of a motion to the number of attempts at the motion may be generated as the exercise accuracy information of the previous exercise mode. For example, basic exercise information may include the generated exercise accuracy information.

According to an embodiment, when the exercise accuracy of the previous exercise mode is less than a preset threshold accuracy, the electronic device may determine that the previous exercise mode is not suitable for the user. For example, when the electronic device determines that the previous exercise mode is not suitable for the user, the electronic device may lower a difficulty level of the previous exercise mode. For example, the electronic device may lower a repetition tempo of full squat.

Figure 16:
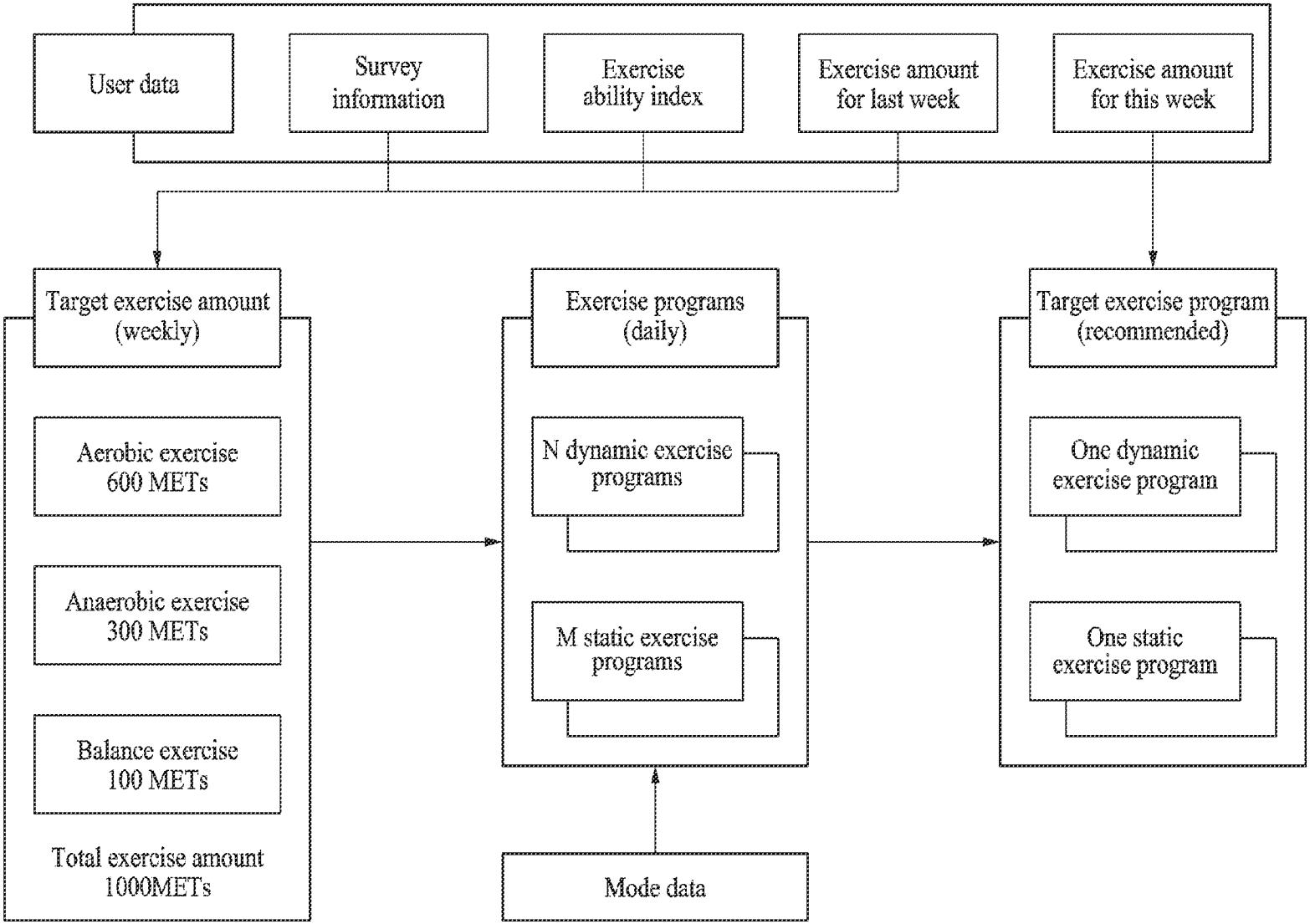
FIG. 16 is a schematic diagram illustrating an example method of recommending a target exercise program to a user according to an example embodiment.

FIG. 16 is a schematic diagram illustrating an example method of recommending a target exercise program to a user according to an embodiment.

According to an embodiment, a system (e.g., the system of FIG. 1) for providing an exercise program to a user may obtain, as user data, survey information, an exercise ability index, an exercise amount for a previous week, and an exercise amount for a current week. Additionally, the system may manage a history of an exercise program performed by the user.

According to an embodiment, the system may determine a target exercise amount (e.g., a weekly target exercise amount) for the user. For example, the system may calculate the target exercise amount and a target exercise effect amount of the target exercise amount based on the user data. For example, the weekly target exercise amount for the user may be determined to be 1000 METs, and the target exercise effect amount may be determined to be 600 METs for an aerobic exercise, 300 METs for an anaerobic exercise (or muscle exercise), and 100 METs for a balance exercise.

According to an embodiment, the target exercise amount may be determined based on an exercise amount for a previous week. For example, when the user achieves a weekly target exercise amount set for the previous week, the weekly target exercise amount may be maintained or increased for a current week. For example, when the user fails to achieve the weekly target exercise amount set for the previous week, the weekly target exercise amount may be reduced for the current week.

According to an embodiment, the system may generate a plurality of exercise programs. For example, the system may generate a plurality of exercise programs on a daily basis based on the user data and mode data. The mode data may be information about each exercise mode. The information about each exercise mode may include, for example, posture information, information about muscles used, and information about effects, which are related to a motion of a corresponding exercise mode. The information about each exercise mode may include, for example, information about an amount of metabolic consumption according to a motion difficulty level (e.g., tempo and resistance level) of a corresponding exercise mode.

According to an embodiment, a plurality of exercise programs may be generated for each exercise program attribute.

Each embodiment herein may be used in combination with any other embodiment(s) described herein.

According to an embodiment, the system may determine a target exercise program from among the generated exercise programs based on a target exercise amount (e.g., a daily target exercise amount) and recommend the determined target exercise program to the user. For example, an exercise program with which the daily target exercise amount and a daily target exercise effect amount are achievable may be determined to be the target exercise program.

According to an embodiment, the system may determine the target exercise program from among the exercise programs based on an exercise amount previously performed by the user and an exercise effect amount. For example, when the user performs a walking exercise without wearing a wearable device, the system may calculate a current exercise amount and a current exercise effect amount for the walking exercise, and subtract the calculated current exercise amount and the calculated exercise effect amount from a daily target exercise amount and a daily target exercise effect amount. The system may then determine the target exercise program corresponding to a corrected daily target exercise amount and a corrected daily target exercise effect amount. "Based on" as used herein covers based at least on.

The embodiments described herein may be implemented using hardware components, software components and/or combinations thereof. A processing device may be implemented using one or more general-purpose or special purpose computers, such as, for example, a processor, a controller and an arithmetic logic unit (ALU), a digital signal processor, a microcomputer, a field programmable gate array (FPGA), a programmable logic unit (PLU), a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such as parallel processors. Each "processor" herein comprises processing circuitry.

Software may include a computer program, a piece of code, an instruction, or some combination thereof, to independently or collectively instruct or configure the processing device to operate as desired. Software and/or data may be embodied permanently or temporarily in any type of machine, component, physical or virtual equipment, computer storage medium or device, or in a propagated signal wave capable of providing instructions or data to or being interpreted by the processing device. The software also may be distributed over network-coupled computer systems so that the software is stored and executed in a distributed fashion. The software and data may be stored by one or more non-transitory computer-readable recording mediums.

The methods according to the above-described examples may be recorded in non-transitory computer-readable media including program instructions to implement various operations of the above-described examples. The media may also include, alone or in combination with the program instructions, data files, data structures, and the like. The program instructions recorded on the media may be those specially designed and constructed for the purposes of examples, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher-level code that may be executed by the computer using an interpreter.

The above-described hardware devices may be configured to act as one or more software modules in order to perform the operations of the above-described examples, or vice versa. The term "software module" as used herein may include various processing circuitry and/or executable program instructions. The same applies to "software modules."

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents.

Therefore, the scope of the disclosure is defined not by the detailed description, but by the claims and their equivalents, and all variations within the scope of the claims and their equivalents are to be construed as being included in the disclosure.

While the disclosure has been illustrated and described with reference to various embodiments, it will be understood that the various embodiments are intended to be illustrative, not limiting. It will further be understood by those skilled in the art that various changes in form and detail may be made without departing from the true spirit and full scope of the disclosure, including the appended claims and their equivalents. It will also be understood that any of the embodiment(s) described herein may be used in conjunction with any other embodiment(s) described herein.

What is claimed is:

1. A server, comprising:

at least one processor comprising processing circuitry, memory comprising one or more storage media storing instructions, wherein the instructions, when executed by the at least one processor, individually and/or collectively, cause the server to:

obtain basic exercise information of a user of an electronic device, wherein the basic exercise information comprises an exercise ability index based on sensing data from a wearable device to be worn on the user, and the sensing data for the exercise ability index is generated by the wearable device when an exercise ability indicator measurement mode is activated on the wearable device;

determine at least one candidate exercise mode from among a plurality of exercise modes stored in the server based on the basic exercise information;

generate a plurality of exercise programs to comprise at least some of the at least one candidate exercise mode based on a target exercise result for the user; determine a target exercise amount for the user based on the basic exercise information;

determine a target exercise program from among the plurality of exercise programs based on the target exercise amount; and control to transmit information related to the target exercise program to the electronic device;

wherein the instructions, when executed by the at least one processor, individually or collectively, cause the server to:

generate a first exercise program based on a first exercise time set for a first exercise mode among the candidate exercise modes and a second exercise time set for a second exercise mode among the candidate exercise modes.

2. The server of claim 1, wherein the basic exercise information comprises physical information comprising at least one of a gender, an age, a weight, a height, an exercise purpose, and a disease type of the user.

3. The server of claim 1, wherein the sensing data for the exercise ability index is to be generated by the wearable device when the exercise ability indicator measurement mode is activated on the wearable device under target resistance profile for a target motion which is one or more motions to be performed by the user to measure the exercise ability index.

4. The server of claim 1, wherein the instructions executed by the at least one processor, individually and/or collectively, cause the server to:

determine the target exercise result for the user based on the basic exercise information, wherein the target exercise result comprises at least one of a muscle part to be stimulated, a type of exercise effect, or posture correction.

5. The server of claim 1, wherein the instructions, when executed by the at least one processor, individually and/or collectively, cause the server to:

determine a first correlation between exercise modes in the first exercise program; and based on the first correlation being greater than or equal to a preset threshold correlation, exclude the first exercise program from the plurality of exercise programs.

6. The server of claim 1, wherein the instructions, executed by the at least one processor, individually and/or collectively, cause the server to:

determine a first exercise result of performing the first exercise program;

determine a first similarity between the target exercise result and the first exercise result; and based on the first similarity being greater than or equal to a preset threshold similarity, change the first exercise mode in the first exercise program to a third exercise mode.

7. The server of claim 1, wherein a plurality of exercise modes determined in slots of a main exercise in the first exercise program are of the same type.

8. The server of claim 1, wherein the instructions, when executed by the at least one processor, individually and/or collectively, cause the server to:

determine a recommended exercise amount for the user based on the basic exercise information;

determine the target exercise amount based on the recommended exercise amount;

determine a target exercise effect combination ratio based on the basic exercise information;

determine a target exercise effect amount based on the target exercise amount and the target exercise effect combination ratio; and determine the target exercise program from among the plurality of exercise programs based on the target exercise amount and the target exercise effect amount.

9. The server of claim 8, wherein the instructions, when executed by the at least one processor, individually and/or collectively, cause the server to:

determine a current exercise amount and a current exercise effect amount of an exercise performed by the user; and determine the target exercise program from among the plurality of exercise programs based on the target exercise amount, the current exercise amount, the target exercise effect amount, and the current exercise effect amount.

10. The server of claim 1, wherein the instructions, when executed by the at least one processor, individually and/or collectively, cause the server to:

receive additional information related to the user from the electronic device;

determine the target exercise program from among the plurality of exercise programs based on the additional information and the target exercise amount.

11. The server of claim 10, wherein the additional information comprises at least one of weather information related to a location of the user or a current time.

12. The server of claim 10, wherein the additional information comprises information related to mobility of the user.

13. The server of claim 1, wherein the basic exercise information comprises exercise accuracy information of a previous exercise program performed by the user.

14. The server of claim 13, wherein the instructions, when executed by the at least one processor, individually and/or collectively, cause the server to:

generate the exercise accuracy information of a previous exercise mode based on a determination of whether the user has correctly performed a motion of the previous exercise mode comprised in the previous exercise program based on sensing data received from the electronic device.

15. The server of claim 1, wherein the instructions are configured so that an operation of a wearable device to be worn on the user is to be controlled based on information related to the target exercise program.

16. The server of claim 15, wherein a resistance force and/or an assistance force is to be provided to the user by the wearable device.

17. An exercise program determining method performed by a server, the method comprising:

obtaining basic exercise information of a user of an electronic device, wherein the basic exercise information comprises an exercise ability index based on sensing data from a wearable device to be worn on the user, and the sensing data for the exercise ability index is generated by the wearable device when an exercise ability indicator measurement mode is activated on the wearable device under target resistance profile for a target motion which is one or more motions to be performed by the user to measure the exercise ability index;

determining at least one candidate exercise mode from among a plurality of exercise modes stored in the server based on the basic exercise information;

generating a plurality of exercise programs to comprise at least some of the at least one candidate exercise mode based on a target exercise result for the user;

determining a target exercise amount for the user based on the basic exercise information;

determining a target exercise program from among the plurality of exercise programs based on the target exercise amount; and transmitting information related to the target exercise program to the electronic device;

wherein the generating the plurality of exercise programs comprises generating a first exercise program based on a first exercise time set for a first exercise mode among the candidate exercise modes and a second exercise time set for a second exercise mode among the candidate exercise modes.

18. An electronic device, comprising:

at least one processor comprising processing circuitry, memory comprising one or more storage media storing instructions, wherein the instructions, when executed by the at least one processor, individually and/or collectively, cause the electronic device to:

obtain basic exercise information of a user of the electronic device, wherein the basic exercise information comprises an exercise ability index based on sensing data from a wearable device to be worn on the user, and the sensing data for the exercise ability index is generated by the wearable device when an exercise ability indicator measurement mode is activated on the wearable device;

determine at least one candidate exercise mode from among a plurality of exercise modes based on the basic exercise information;

generate a plurality of exercise programs to comprise at least some of the at least one candidate exercise mode based on a target exercise result for the user;

determine a target exercise amount for the user based on the basic exercise information;

determine a target exercise program from among the plurality of exercise programs based on the target exercise amount; and control a wearable device based on the target exercise program;

wherein the instructions, when executed by the at least one processor, individually or collectively, cause the electronic device to:

generate a first exercise program based on a first exercise time set for a first exercise mode among the candidate exercise modes and a second exercise time set for a second exercise mode among the candidate exercise modes.

19. The electronic device of claim 18, wherein the instructions, when executed by the at least one processor, individually and/or collectively, cause the electronic device server to:

determine a recommended exercise amount for the user based on the basic exercise information;

determine the target exercise amount based on the recommended exercise amount;

determine a target exercise effect combination ratio based on the basic exercise information;

determine a target exercise effect amount based on the target exercise amount and the target exercise effect combination ratio; and determine the target exercise program from among the plurality of exercise programs based on the target exercise amount and the target exercise effect amount.

* * * * *